US009697840B2

(12) United States Patent
Biswas et al.

(10) Patent No.: US 9,697,840 B2
(45) Date of Patent: Jul. 4, 2017

(54) ENHANCED CHROMA EXTRACTION FROM AN AUDIO CODEC

(71) Applicant: DOLBY INTERNATIONAL AB, Amsterdam Zuidoost (NL)

(72) Inventors: Arijit Biswas, Nuremberg (DE); Marco Fink, Hamburg (DE); Michael Schug, Erlangen (DE)

(73) Assignee: Dolby International AB, Amsterdam Zuidoost (NL)

( * ) Notice: Subject to any disclaimer, the term of this patent is extended or adjusted under 35 U.S.C. 154(b) by 141 days.

(21) Appl. No.: 14/359,697

(22) PCT Filed: Nov. 28, 2012

(86) PCT No.: PCT/EP2012/073825
§ 371 (c)(1),
(2) Date: May 21, 2014

(87) PCT Pub. No.: WO2013/079524
PCT Pub. Date: Jun. 6, 2013

(65) Prior Publication Data

US 2014/0310011 A1 Oct. 16, 2014

Related U.S. Application Data

(60) Provisional application No. 61/565,037, filed on Nov. 30, 2011.

(51) Int. Cl.
*G10L 19/02* (2013.01)
*G10L 19/038* (2013.01)
(Continued)

(52) U.S. Cl.
CPC ..... *G10L 19/02* (2013.01); *G10H 1/0008* (2013.01); *G10H 1/383* (2013.01); *G10L 19/038* (2013.01);
(Continued)

(58) Field of Classification Search
None
See application file for complete search history.

(56) References Cited

U.S. PATENT DOCUMENTS 6,930,235 B2 * 8/2005 Sandborn ..... G09B 15/02 84/464 R
7,582,823 B2 9/2009 Kim
(Continued)

FOREIGN PATENT DOCUMENTS

JP 2001-154698 6/2001
JP 2006-018023 1/2006
(Continued)

OTHER PUBLICATIONS

Ravelli, et al "Audio Signal Representations for Indexing in the Transform Domain" IEEE Trans. ASLP vol. 18, No. 3 Mar 2010.*
(Continued)

*Primary Examiner* — Pierre-Louis Desir
*Assistant Examiner* — Yi-Sheng Wang

(57) ABSTRACT

The present document relates to methods and systems for music information retrieval (MIR). In particular, the present document relates to methods and systems for extracting a chroma vector from an audio signal. A method (900) for determining a chroma vector (100) for a block of samples of an audio signal (301) is described. The method (900) comprises receiving (901) a corresponding block of frequency coefficients derived from the block of samples of the audio signal (301) from a core encoder (412) of a spectral band replication based audio encoder (410) adapted to generate an encoded bitstream (305) of the audio signal (301) from the block of frequency coefficients; and determining (904) the chroma vector (100) for the block of samples of the audio signal (301) based on the received block of frequency coefficients.

19 Claims, 10 Drawing Sheets

(51) Int. Cl.

| | |
|---|---|
| ***G10L 25/54*** | (2013.01) |
| ***G10H 1/00*** | (2006.01) |
| ***G10H 1/38*** | (2006.01) |
| *G10L 19/022* | (2013.01) |
| *G10L 21/0388* | (2013.01) |

(52) U.S. Cl.
CPC ..... *G10L 25/54* (2013.01); *G10H 2210/066* (2013.01); *G10H 2250/225* (2013.01); *G10L 19/022* (2013.01); *G10L 21/0388* (2013.01)

(56) References Cited

U.S. PATENT DOCUMENTS

| | | | | |
|---|---|---|---|---|
| 7,627,481 | B1 | 12/2009 | Kuo | |
| 8,463,719 | B2 * | 6/2013 | Lyon | G06F 17/30743 706/12 |
| 2009/0107321 | A1 | 4/2009 | Van De Par | |
| 2009/0254352 | A1 | 10/2009 | Zhao | |

FOREIGN PATENT DOCUMENTS

| | | |
|---|---|---|
| WO | 2011/051279 | 5/2011 |
| WO | 2011/071610 | 6/2011 |

OTHER PUBLICATIONS

Ravelli, et al "Audio Signal Representations for Indexing in the Transform Domain" IEEE Trans. ASLP vol. 18, No. 3 Mar. 2010.*
Lidy, et al "Evaluation of Feature Extractors and Psycho-acoustic Transformations for Music Genre Classification", 6th ISMIR, Sep. 11-15, 2005, Queen Mary, University of London.*
Friedrich, et al "A Fast Feature Extraction System on Compressed Audio Data" AES conv. May 17-20, 2008, Amsterdam, The Netherlands.*
RFC 3119, "A More Loss-Tolerant RTP Payload Format for MP3 Audio" Jun. 2001.*
Fielder, et al "Introduction to Dolby Digital Plus, an Enhancement to the Dolby Digital Coding System", AES conv. Oct. 28-31, 2004, San Francisco CA, USA.*
Schuller, et al "A Fast Feature Extraction System on Compressed Audio Data", IEEE Journal of Selected Topics in Signal Processing, vol. 5, No. 6, Oct. 2011.*
Li, et al "Robust Audio Identification for MP3 Popular Music", SIGIR'10, Jul. 19-23, 2010, Geneva, Switzerland.*
Goto, "A chorus Section Detection Method for Musical Audio Signals and Its Application to a Music Listening Station" IEEE Trans. ASLP vol. 14, No. 5, Sep. 2006.*
Wolters, et al "A Closer Look into MPEG-4 High Efficiency AAC", AES conv. Oct. 10-13, 2003, NewYork, NY, USA.*
Ravelli, E. et al "Audio Signal Representations for Indexing in the Transform Domain" IEEE Transactions on Audio, Speech, and Language Processing, vol. 18, No. 3, Mar. 2010, pp. 434-446.
Schuller, G. et al "Fast Audio Feature Extraction From Compressed Audio Data" IEEE Journal of Selected Topics in Signal Processing, vol. 5, No. 6, Oct. 2011, pp. 1262-1271.
Rizzi, A. et al "Optimal Short-Time Features for Music/Speech Classification of Compressed Audio Data" International Conference on Computational Intelligence for Modelling Control and Automation, and International Conference on Intelligent Agents 2006.
Fink, Marco, "Chromagram Computation in the MDCT Domain Controlled by a Psychoacoustic Model" Diploma Thesis, Dec. 2011.
3GPP TS 26.403 May 2004; "3rd Generation Partnership Project; Technical Specification Group SErvices and System Aspects; General Audio Codec Audio Processing Functions" Enhanced aacPlus General Audio Codec; Encoder Specification AAC part (Release 6).
Hollosi, D. et al "Complexity Scalable Perceptual Tempo Estimation from HE-AAC Encoded Music" AES Convention Paper 8109 presented at the 128th Convention, May 22-25, 2010, London, UK.
Goto, Masataka "A Chorus Section Detection Method for Musical Audio Signals and Its Application to a Music Listening Station" IEEE Transactions on Audio, Speech, and Language Processing, vol. 14, No. 5, Sep. 2006, pp. 1783-1794.
Stein, M. et al "Evaluation and Comparison of Audio Chroma Feature Extraction Methods" 126th AES Convention, Munich, Germany, May 1, 2009.
ISO 13818-7:2005, Coding of Moving Pictures and Audio, 2005.
ISO 14496-3:2009, "Information Technology—Coding of Audio-Visual Objects" Part 3: Audio, 2009.

* cited by examiner

ENHANCED CHROMA EXTRACTION FROM AN AUDIO CODEC

CROSS REFERENCE TO RELATED APPLICATIONS

This application claims priority to U.S. Provisional Patent Application No. 61/565,037 filed 30 Nov. 2011, hereby incorporated by reference in its entirety.

TECHNICAL FIELD OF THE INVENTION

The present document relates to methods and systems for music information retrieval (MIR). In particular, the present document relates to methods and systems for extracting a chroma vector from an audio signal in conjunction with (e.g. during) an encoding process of the audio signal.

BACKGROUND OF THE INVENTION

Navigating through available music libraries is becoming more and more difficult due to the fact that the amount of easily accessible data has increased significantly over the last few years. An interdisciplinary field of research called Music Information Retrieval (MIR) investigates solutions to structure and classify musical data, to help users exploring their media. For example, it is desirable that MIR based methods are capable of classifying music in order to propose similar types of music. MIR techniques may be based on a mid-level time-frequency representation called chromagram, which specifies the energy distribution of semitones over time. The chromagram of an audio signal may be used to identify harmonic information (e.g. information about the melody and/or information about the chords) of the audio signal. However, the determination of a chromagram is typically linked to significant computational complexity.

The present document addresses the complexity issue of chromagram computation methods and describes methods and systems for chromagram computation at reduced computational complexity. In particular, methods and systems for the efficient computation of perceptually motivated chromagrams are described.

SUMMARY OF THE INVENTION

According to an aspect, a method for determining a chroma vector for a block of samples of an audio signal is described. The block of samples may be a so called long-block of samples, which is also referred to as a frame of samples. The audio signal may e.g. be a music track. The method comprises the step of receiving a corresponding block of frequency coefficients derived from the block of samples of the audio signal from an audio encoder (e.g. an AAC (Advanced Audio Coding) or an mp3 encoder). The audio encoder may be the core encoder of a spectral band replication (SBR) based audio encoder. By way of example, the core encoder of the SBR based audio encoder may be an AAC or an mp3 encoder, and more particularly, the SBR based audio encoder may be a HE (High Efficiency) AAC encoder or mp3PRO. A further example of an SBR based audio encoder to which the methods described in the present document are applicable is the MPEG-D USAC (Universal Speech and Audio Codec) encoder.

The (SBR based) audio encoder is typically adapted to generate an encoded bitstream of the audio signal from the block of frequency coefficients. For this purpose, the audio encoder may quantize the block of frequency coefficients and may entropy encode the quantized block of frequency coefficients.

The method further comprises determining the chroma vector for the block of samples of the audio signal based on the received block of frequency coefficients. In particular, the chroma vector may be determined from a second block of frequency coefficients, which is derived from the received block of frequency coefficients. In an embodiment, the second block of frequency coefficients is the received block of frequency coefficients. This may be the case if the received block of frequency coefficients is a long-block of frequency coefficients. In another embodiment, the second block of frequency coefficients corresponds to an estimated long-block of frequency coefficients. This estimated long-block of frequency coefficients may be determined from a plurality of short-blocks comprised within the received block of frequency coefficients.

The block of frequency coefficients may be a block of Modified Discrete Cosine Transformation (MDCT) coefficients. Other examples of time-domain to frequency-domain transformations (and the resulting block of frequency coefficients) are transforms such as MDST (Modified Discrete Sine Transform), DFT (Discrete Fourier Transform) and MCLT (Modified Complex Lapped Transform). In general terms, the block of frequency coefficients may be determined from the corresponding block of samples using a time-domain to frequency-domain transform. Inversely, the block of samples may be determined from the block of frequency coefficients using the corresponding inverse transform.

The MDCT is an overlapped transform which means that, in such cases, the block of frequency coefficients is determined from the block of samples and additional further samples of the audio signal from the direct neighborhood of the block of samples. In particular, the block of frequency coefficients may be determined from the block of samples and the directly preceding block of samples.

The block of samples may comprise N succeeding short-blocks of M samples each. In other words, the block of samples may be (or may comprise) a sequence of N short-blocks. In a similar manner, the block of frequency coefficients may comprises N corresponding short-blocks of M frequency coefficients each. In an embodiment, $M=128$ and $N=8$, which means that the block of samples comprises $M \times N=1024$ samples. The audio encoder may make use of short-blocks for encoding transient audio signals, thereby increasing the time resolution while decreasing the frequency resolution.

When receiving a sequence of short-blocks from the audio encoder, the method may comprise additional steps to increase the frequency resolution of the received sequence of short-blocks of frequency coefficients and to thereby enable the determination of a chroma vector for the entire block of samples (which comprises the sequence of short-blocks of samples). In particular, the method may comprise estimating a long-block of frequency coefficients corresponding to the block of samples from the N short-blocks of M frequency coefficients. The estimation is performed such that the estimated long-block of frequency coefficients has an increased frequency resolution compared to the N short-blocks of frequency coefficients. In such cases, the chroma vector for the block of samples of the audio signal may be determined based on the estimated long-block of frequency coefficients.

It should be noted that the step of estimating a long-block of frequency coefficients may be performed in a hierarchical manner for different levels of aggregation. This means that a plurality of short-blocks may be aggregated to a long-block, and a plurality of long-blocks may be aggregated to a super long-block, etc. As a result, different levels of frequency resolution (and correspondingly time resolution) can be provided. By way of example, a long-block of frequency coefficients may be determined from a sequence of N short-blocks (as outlined above). At the next hierarchical level, a sequence of N2 long-blocks of frequency coefficients (of which some or all may have been estimated from corresponding sequences of N short-blocks) may be converted into a super long-block of N2 times more frequency coefficients (and a correspondingly higher frequency resolution). As such, the methods for estimating a long-block of frequency coefficients from a sequence of short-blocks of frequency coefficients may be used for hierarchically increasing the frequency resolution of a chroma vector (while at the same time, hierarchically decreasing the time resolution of the chroma vector).

The step of estimating the long-block of frequency coefficients may comprise interleaving corresponding frequency coefficients of the N short-blocks of frequency coefficients, thereby yielding an interleaved long-block of frequency coefficients. It should be noted that such interleaving may be performed by the audio encoder (e.g. the core encoder) in the context of quantizing and entropy encoding of the block of frequency coefficients. As such, the method may alternatively comprise the step of receiving the interleaved long-block of frequency coefficients from the audio encoder. Consequently, no additional computational resources would be consumed by the interleaving step. The chroma vector may be determined from the interleaved long-block of frequency coefficients. Furthermore, the step of estimating the long-block of frequency coefficients may comprise decorrelating the N corresponding frequency coefficients of the N short-blocks of frequency coefficients by applying a transform with energy compaction property (in the low frequency bins of the transform compared to the high frequency bins), e.g. a DCT-II transform, to the interleaved long-block of frequency coefficients. This decorrelating scheme using an energy compacting transform, e.g. a DCT-II transform, may be referred to as an Adaptive Hybrid Transform (AHT) scheme. The chroma vector may be determined from the decorrelated, interleaved long-block of frequency coefficients.

Alternatively, the step of estimating the long-block of frequency coefficients may comprise applying a polyphase conversion (PPC) to the N short-blocks of M frequency coefficients. The polyphase conversion may be based on a conversion matrix for mathematically transforming the N short-blocks of M frequency coefficients to an accurate long-block of N×M frequency coefficients. As such, the conversion matrix may be determined mathematically from the time-domain to frequency-domain transformation performed by the audio encoder (e.g. the MDCT). The conversion matrix may represent the combination of an inverse transformation of the N short-blocks of frequency coefficients into the time-domain and the subsequent transformation of the time-domain samples to the frequency-domain, thereby yielding the accurate long-block of N×M frequency coefficients. The polyphase conversion may make use of an approximation of the conversion matrix with a fraction of conversion matrix coefficients set to zero. By way of example, a fraction of 90% or more of the conversion matrix coefficients may be set to zero. As a result, the polyphase conversion may provide an estimated long-block of frequency coefficient at low computational complexity. Furthermore, the fraction may be used as a parameter to vary the quality of the conversion as a function of complexity. In other words, the fraction may be used to provide a complexity scalable conversion.

It should be noted that the AHT (as well as the PPC) may be applied to one or more sub-sets of the sequence of short-blocks. As such, estimating the long-block of frequency coefficients may comprise forming a plurality of sub-sets of the N short-blocks of frequency coefficients. The sub-sets may have a length of L short-blocks, thereby yielding N/L sub-sets. The number of short-blocks L per sub-set may be selected based on the audio signal, thereby adapting the AHT/PPC to the particular characteristics of the audio signal (i.e. the particular frame of the audio signal).

In the case of AHT, for each sub-set, corresponding frequency coefficients of the short-blocks of frequency coefficients may be interleaved, thereby yielding an interleaved intermediate-block of frequency coefficients (with L×M coefficients) for the sub-set. Furthermore, for each sub-set, an energy compacting transform, e.g. a DCT-II transform, may be applied to the interleaved intermediate-block of frequency coefficients of the sub-set, thereby increasing the frequency resolution of the interleaved intermediate-block of frequency coefficients. In the case of PPC, an intermediate conversion matrix for mathematically transforming the L short-blocks of M frequency coefficients to an accurate intermediate-block of L×M frequency coefficients may be determined. For each sub-set, the polyphase conversion (which may be referred to as intermediate polyphase conversion) may make use of an approximation of the intermediate conversion matrix with a fraction of intermediate conversion matrix coefficients set to zero.

More generally, it may be stated that the estimation of the long-block of frequency coefficients may comprise the estimation of a plurality of intermediate-blocks of frequency coefficients from the sequence of short-blocks (for the plurality of sub-sets). A plurality of chroma vectors may be determined from the plurality of intermediate-blocks of frequency coefficients (using the methods described in the present document). As such, the frequency resolution (and the time-resolution) for the determination of chroma vectors may be adapted to the characteristics of the audio signal.

The step of determining the chroma vector may comprise applying frequency dependent psychoacoustic processing to the second block of frequency coefficients derived from the received block of frequency coefficients. The frequency dependent psychoacoustic processing may make use of a psychoacoustic model provided by the audio encoder.

In an embodiment, applying frequency dependent psychoacoustic processing comprises comparing a value derived from at least one frequency coefficient of the second block of frequency coefficients to a frequency dependent energy threshold (e.g. a frequency dependent and psychoacoustic masking threshold). The value derived from the at least one frequency coefficient may correspond to an average energy value (e.g. a scale factor band energy) derived from a plurality of frequency coefficients for a corresponding plurality of frequencies (e.g. a scale factor band). In particular, the average energy value may be an average of the plurality of frequency coefficients. As a result of the comparing, the frequency coefficient may be set to zero if the frequency coefficient is below the energy threshold. The energy threshold may be derived from the psychoacoustic model applied by the audio encoder, e.g. by the core encoder of the SBR based audio encoder. In particular, the energy threshold may be derived from a frequency dependent masking threshold used by the audio encoder to quantize the block of frequency coefficients.

The step of determining the chroma vector may comprise classifying some or all of the frequency coefficients of the second block to tone classes of the chroma vector. Subsequently, cumulated energies for the tone classes of the chroma vector may be determined based on the classified frequency coefficients. By way of example, the frequency coefficients may be classified using band pass filters associated with the tone classes of the chroma vector.

A chromagram of the audio signals (comprising a sequence of blocks of samples) may be determined by determining a sequence of chroma vectors from the sequence of blocks of samples of the audio signal, and by plotting the sequence of chroma vectors against a time line associated with the sequence of blocks of samples. In other words, by iterating the methods outlined in the present document for a sequence of blocks of samples (i.e. for a sequence of frames), reliable chroma vectors may be determined on a frame-by-frame basis without ignoring any frame (e.g. without ignoring frames for transient audio signals which comprise a sequence of short-blocks). Consequently, a continuous chromagram (comprising (at least) one chroma vector per frame) may be determined.

According to another aspect, an audio encoder adapted to encode an audio signal is described. The audio encoder may comprise a core encoder adapted to encode a (possibly downsampled) low frequency component of the audio signal. The core encoder is typically adapted to encode a block of samples of the low frequency component by transforming the block of samples into the frequency domain, thereby yielding a corresponding block of frequency coefficients. Furthermore, the audio encoder may comprise a chroma determination unit adapted to determine a chroma vector of the block of samples of the low frequency component of the audio signal based on the block of frequency coefficients. For this purpose, the chroma determination unit may be adapted to execute any of the method steps outlined in the present document. The encoder may further comprise a spectral band replication encoder adapted to encode a corresponding high frequency component of the audio signal. In addition, the encoder may comprise a multiplexer adapted to generate an encoded bitstream from data provided by the core encoder and the spectral band replication encoder. In addition, the multiplexer may be adapted to add information derived from the chroma vector (e.g. high level information derived from chroma vectors such as chords and/or keys) as metadata to the encoded bitstream. By way of example, the encoded bitstream may be encoded in any one of: an MP4 format, 3GP format, 3G2 format, LATM format.

It should be noted that the methods described in the present document may be applied to an audio decoder (e.g. an SBR based audio encoder). Such audio decoders typically comprise a demultiplexing and decoding unit adapted to receive the encoded bitstream and adapted to extract the (quantized) blocks of frequency coefficients from the encoded bitstream. These blocks of frequency coefficients may be used to determine a chroma vector as outlined in the present document.

Consequently, an audio decoder adapted to decode an audio signal is described. The audio decoder comprises a demultiplexing and decoding unit adapted to receive a bitstream and adapted to extract a block of frequency coefficients from the received bitstream. The block of frequency coefficients is associated with a corresponding block of samples of a (downsampled) low frequency component of the audio signal. In particular, the block of frequency coefficients may correspond to a quantized version of a corresponding block of frequency coefficients derived at the corresponding audio encoder. The block of frequency coefficients at the decoder may be converted into the time-domain (using an inverse transform) to yield a reconstructed block of samples of the (downsampled) low frequency component of the audio signal.

Furthermore, the audio decoder comprises a chroma determination unit adapted to determine a chroma vector of the block of samples (of the low frequency component) of the audio signal based on the block of frequency coefficients extracted from the bitstream. The chroma determination unit may be adapted to execute any of the method steps outlined in the present document.

Furthermore, it should be noted that some audio decoders may comprise a psychoacoustic model. Examples for such audio decoders are e.g., Dolby Digital and Dolby Digital Plus. This psychoacoustic model may be used for the determination of a chroma vector (as outlined in the present document).

According to a further aspect, a software program is described. The software program may be adapted for execution on a processor and for performing the method steps outlined in the present document when carried out on a computing device.

According to another aspect, a storage medium is described. The storage medium may comprise a software program adapted for execution on a processor and for performing the method steps outlined in the present document when carried out on a computing device.

According to a further aspect, a computer program product is described. The computer program may comprise executable instructions for performing the method steps outlined in the present document when executed on a computer.

It should be noted that the methods and systems including its preferred embodiments as outlined in the present document may be used stand-alone or in combination with the other methods and systems disclosed in this document. Furthermore, all aspects of the methods and systems outlined in the present document may be arbitrarily combined. In particular, the features of the claims may be combined with one another in an arbitrary manner.

DESCRIPTION OF THE DRAWINGS

The invention is explained below in an exemplary manner with reference to the accompanying drawings, wherein.

DETAILED DESCRIPTION OF THE INVENTION

Today's storage solutions have the capacity to provide huge databases of musical content to users. Online streaming services like Simfy offer more than 13 million songs (audio files or audio signals), and these streaming services are faced with the challenge of navigating through large databases, and to select and stream appropriate music tracks to their subscribers. Similarly, users with a large personal collection of music stored in a database have the same problem of selecting appropriate music. In order to be able to handle such large amount of data, new ways of discovering music are desirable. In particular, it may be beneficial that a music retrieval system proposes similar kinds of music to a user when the user's preferred taste of music is known.

In order to identify musical similarity, numerous high-level semantic features such as tempo, rhythm, beat, harmony, melody, genre and mood may be required and may need to be extracted from the musical content. Music-Information-Retrieval (MIR) offers methods to compute many of these musical features. Most MIR strategies rely on a mid-level descriptor, from which necessary high-level musical features are obtained. One example of a mid-level descriptor is the so-called chroma vector 100 illustrated in FIG. 1. A chroma vector 100 usually is a Kdimensional vector, wherein each dimension of the vector corresponds to the spectral energy of a semitone class. In the case of Western music, typically K=12. For other kinds of music, K may have different values. The chroma vector 100 may be obtained by mapping and folding the spectrum 101 of an audio signal at a particular time instant (e.g. determined using the magnitude spectrum of a Short Term Fourier Transform, STFT) into a single octave. As such, chroma vectors capture melodic and harmonic content of the audio signal at the particular time instant, while being less sensitive to changes in timbre compared to the spectrogram 101.

Figure 1:
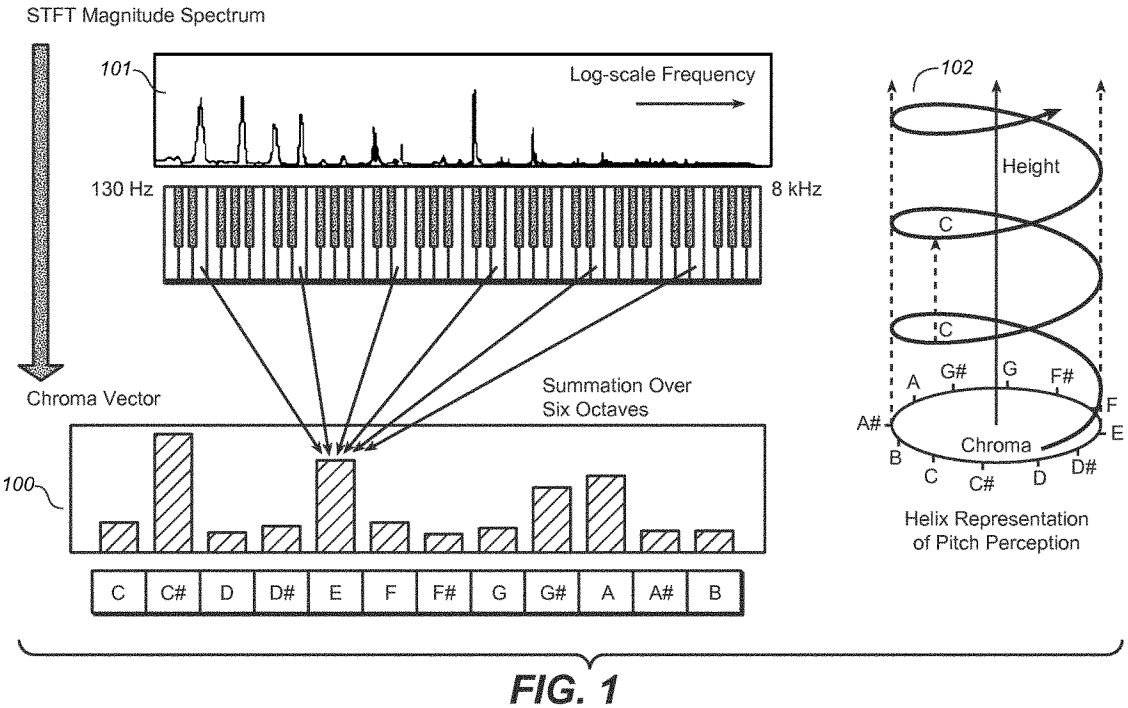
FIG. 1 illustrates an example determination scheme of a chroma vector.

As illustrated in FIG. 1, the chroma features of an audio signal can be visualized by projecting the spectrum 101 on a Shepard's helix representation 102 of musical pitch perception. In the representation 102, chroma refers to the position on the circumference of the helix 102 seen from directly above. On the other hand, the height refers to the vertical position of the helix seen from the side. The height corresponds to the position of an octave, i.e. the height indicates the octave. The chroma vector may be extracted by coiling the magnitude spectrum 101 around the helix 102 and by projecting the spectral energy at corresponding positions on the circumference of the helix 102 but at different octaves (different heights) onto the chroma (or the tone class), thereby summing up the spectral energy of a semitone class.

This distribution of semitone classes captures the harmonic content of an audio signal. The progression of chroma vectors over time is known as chromagram. The chroma vectors and the chromagram representation may be used to identify chord names (e.g., a C major chord comprising large chroma vector values of C, E, and G), to estimate the overall key of an audio signal (the key identifies the tonic triad, the chord, major/minor, which represents the final point of rest of a musical piece, or the focal point of a section of the musical piece), to estimate the mode of an audio signal (wherein the mode is a type of scale, e.g. a musical piece in a major or minor key), to detect intra- and inter-song similarity (harmony/melody similarity within a song or harmony/melody similarity over a collection of songs to create a playlist of similar songs), to identify a song and/or to extract a chorus of the song.

As such, chroma vectors can be obtained by spectral folding of a short term spectrum of the audio signal into a single octave and a following fragmentation of the folded spectrum into a twelve-dimensional vector. This operation relies on an appropriate time-frequency representation of the audio signal, preferably having a high resolution in the frequency domain. The computation of such a time-frequency transformation of the audio signal is computational intensive and consumes the major computation power in known chromagram computation schemes.

In the following, the basic scheme for determining a chroma vector is described. As can be seen from Table 1 (frequencies in Hz for semitones of Western music in the fourth octave), a direct mapping of tones to frequencies is possible when the reference pitch, generally 440 Hz for the tone A4, is known.

TABLE 1

| Hz | 264 | 275 | 297 | 317 | 330 | 352 | 367 | 396 | 422 | 440 | 475 | 495 | 528 |
|---|---|---|---|---|---|---|---|---|---|---|---|---|---|
| tone | C | C# | D | D# | E | F | F# | G | G# | A | A# | B | C |

The factor between the frequencies of two semitones is $$\sqrt[12]{2}$$

and thus the factor between two octaves is $$2 = \sqrt[12]{2}^{12}.$$

Since doubling the frequency is equivalent to raising a tone by one octave, this system can be seen as periodic and can be displayed in the cylindrical coordinate system 102, where the radial axis represents one of the 12 tones or one of the chroma values (referred to as c) and where the longitudinal position represents the tone height (referred to as h). Consequently, the perceived pitch or frequency f can be written as $f=2^{c+h}$, $c\epsilon[0,1)$, $h\epsilon Z$.

Figure 2:
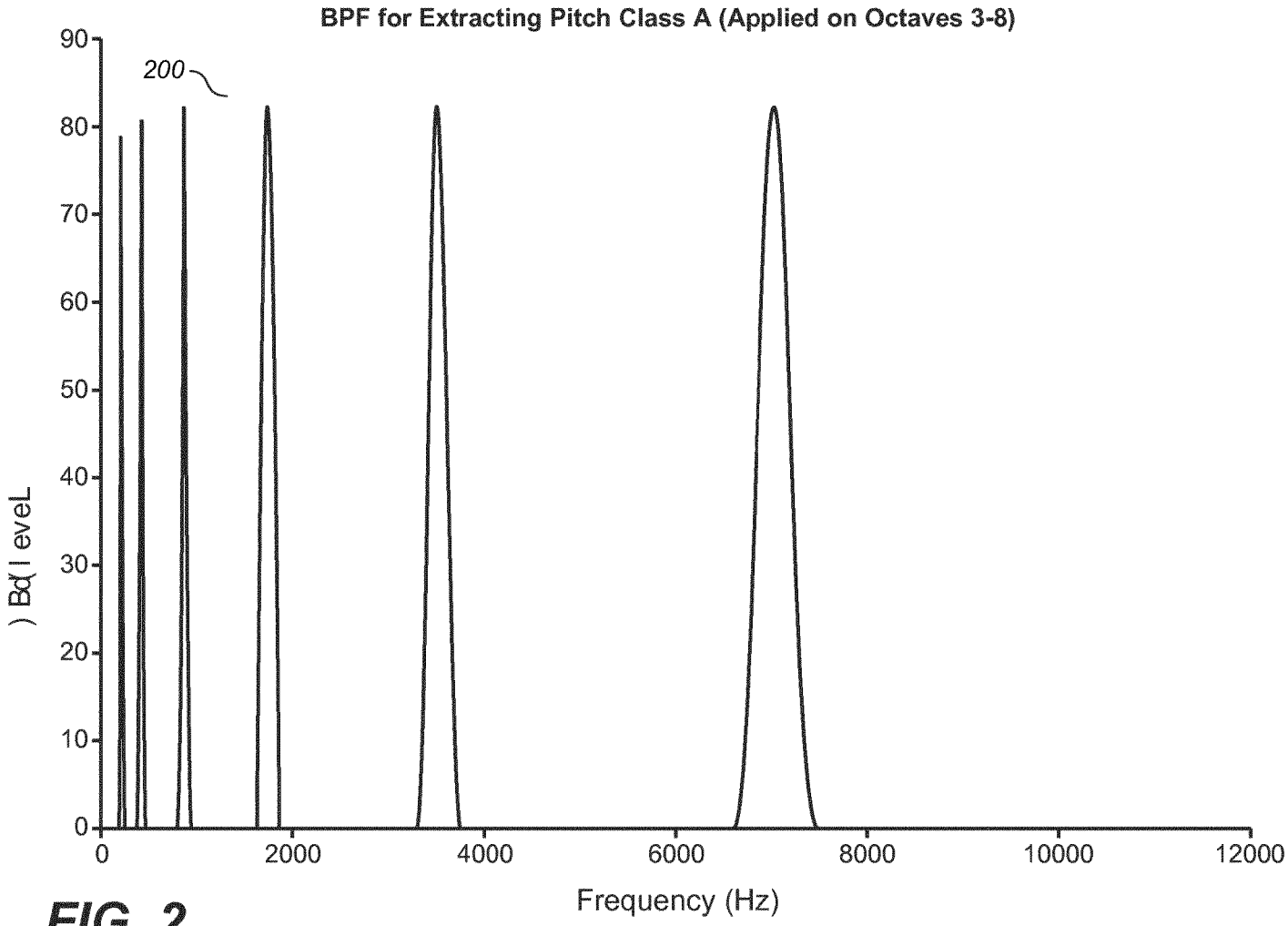
FIG. 2 shows an example bandpass filter for classifying the coefficients of a spectrogram to an example tone class of a chroma vector.

When analyzing an audio signal (e.g. a musical piece) concerning its melody and harmony, a visual display showing its harmonic information over time is desirable. One way is the so-called chromagram where the spectral content of one frame is mapped onto a twelve-dimensional vector of semitones, called a chroma vector, and plotted versus time. The chroma value c can be obtained from a given frequency f by transposing the above mentioned equation as $c=\log_2(f)-\lfloor\log_2(f)\rfloor$, where $\lfloor\ \rfloor$ is the flooring operation which corresponds to the spectral folding of the plurality of octaves onto a single octave (depicted by the Helix representation 102). Alternatively, the chroma vector may be determined by using a set of 12 bandpass filters per octave, wherein each bandpass is adapted to extract the spectral energy of a particular chroma from the magnitude spectrum of the audio signal at a particular time instant. As such, the spectral energy which corresponds to each chroma (or tone class) may be isolated from the magnitude spectrum and subsequently summed up to yield the chroma value c for the particular chroma. An example bandpass filter 200 for the class of tone A is illustrated in FIG. 2. Such a filter based method for determining a chroma vector and a chronogram is described in M. Goto, "A Chorus Section Detection Method for Musical Audio Signals and its Application to a Music Listening Station." *IEEE Trans. Audio, Speech, and Language Processing* 14, no. 5 (September 2006): 1783-1794. Further chroma extraction methods are described in Stein, M., et. al. "Evaluation and Comparison of Audio Chroma Feature Extraction Methods." 126$^{th}$ *AES Convention*. Munich, Germany, 2009. Both documents are incorporated by reference.

As outlined above, the determination of a chroma vector and a chromagram requires the determination of an appropriate time-frequency representation of the audio signal. This is typically linked to high computational complexity. In the present document, it is proposed to reduce the computational effort by integrating the MIR process into an existing audio processing scheme, which already makes use of a similar time-frequency transformation. Desirable qualities of such an existing audio processing scheme would be a time-frequency representation with a high-frequency resolution, an efficient implementation of the time-frequency transformation, and the availability of additional modules that can be used to potentially improve the reliability and quality of the resulting chromagram.

Audio signals (notably music signals) are typically stored and/or transmitted in an encoded (i.e. compressed) format. This means that MIR processes should work in conjunction with encoded audio signals. It is therefore proposed to determine a chroma vector and/or a chromagram of an audio signal in conjunction with an audio encoder, which makes use of a time-frequency transformation. In particular, it is proposed to make use of a high efficiency (HE) encoder/decoder, i.e. an encoder/decoder which makes use of spectral band replication (SBR). An example for such a SBR based encoder/decoder is the HE-AAC (advanced audio coding) encoder/decoder. The HE-AAC codec was designed to deliver a rich listening experience at very low bit-rates and thus is widely used in broadcasting, mobile streaming and download services. An alternative SBR based codec is e.g. the mp3PRO codec, which makes use of an mp3 core encoder instead of an AAC core encoder. In the following, reference will be made to a HE-AAC codec. It should be noted, however, that the proposed methods and systems are also applicable to other audio codecs, notably to other SBR based codecs.

As such, it is proposed in the present document, to make use of the time-frequency transformation available in HE-AAC in order to determine the chroma vectors/the chromagram of an audio signal. As such, the computational complexity for chroma vector determination is significantly reduced. Another advantage of using an audio encoder to obtain chromagrams, besides the saving of computational costs, is the fact that typical audio codecs focus on human perception. This means that typical audio codecs (such as the HE-AAC codec) provide good psychoacoustic tools that could be suitable for further chromagram enhancement. In other words, it is proposed to make use of the psychoacoustic tools available within an audio encoder to enhance the reliability of a chromagram.

Furthermore, it should be noted that also the audio encoder itself benefits from the presence of an additional chromagram computation module since the chromagram computation module allows computing helpful metadata, e.g. chord information, which may be included into the metadata of the bitstream generated by the audio encoder. This additional metadata can be used to offer an enhanced consumer experience at the decoder side. In particular, the additional metadata may be used for further MIR applications.

Figure 3:
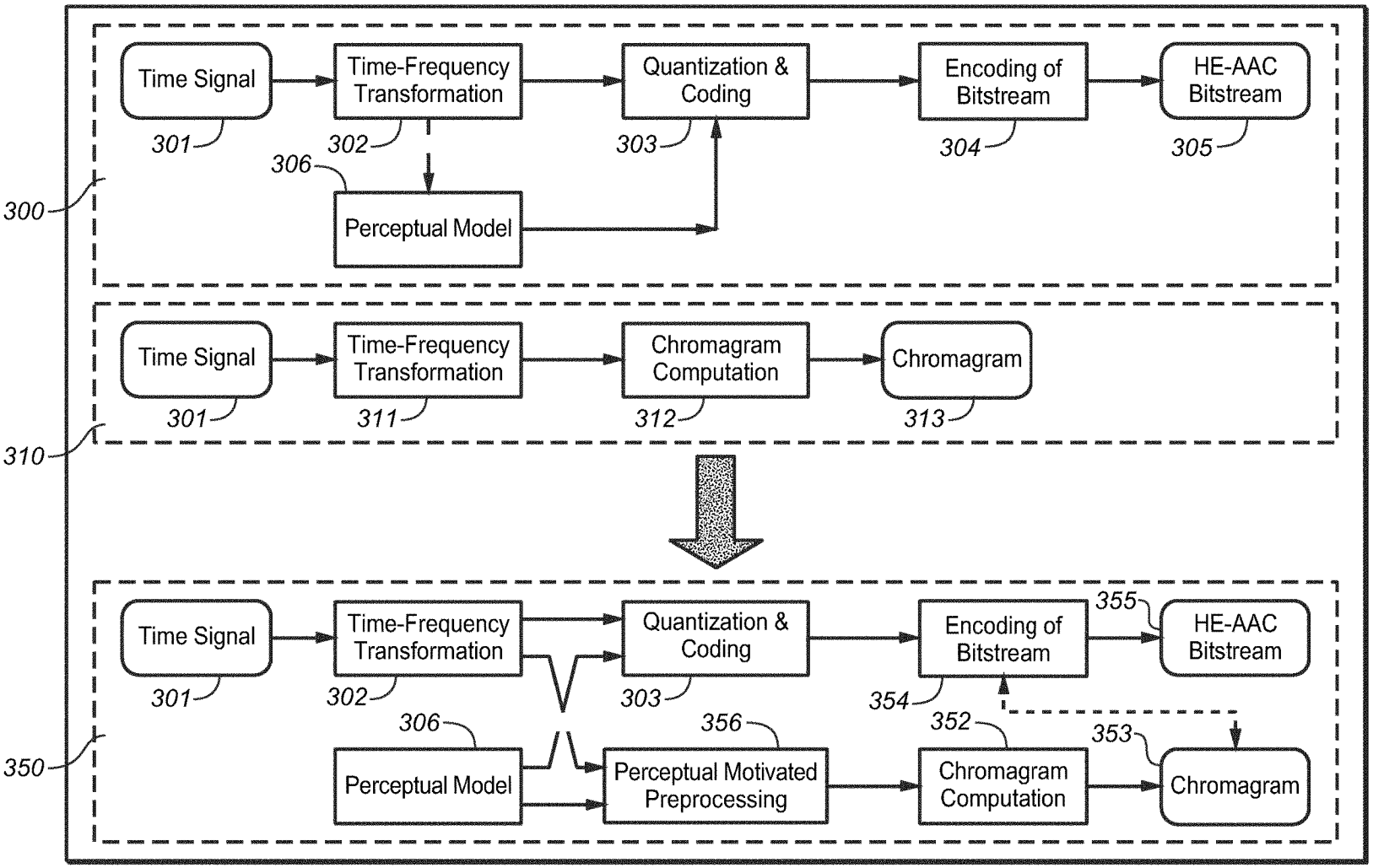
FIG. 3 illustrates a block diagram of an example audio encoder comprising a chroma determination unit.

FIG. 3 illustrates an example block diagram of an audio encoder (e.g. an HE-AAC encoder) 300 and of a chromagram determination module 310. The audio encoder 300 encodes an audio signal 301 by transforming the audio signal 301 in the time-frequency domain using a time-frequency transformation 302. A typical example of such a time-frequency transformation 302 is a Modified Discrete Cosine Transform (MDCT) used e.g. in the context of an AAC encoder. Typically, a frame of samples x[k] of the audio signal 301 is transformed into the frequency domain using a frequency transformation (e.g. the MDCT), thereby providing a set of frequency coefficients X[k]. The set of frequency coefficients X[k] is quantized and encoded in the quantization & coding unit 303, whereby the quantization and coding typically takes into account a perceptual model 306. Subsequently, the coded audio signal is encoded into a particular bitstream format (e.g. an MP4 format, a 3GP format, a 3G2 format, or LATM format) in the encoding unit or multiplexer unit 304. The encoding into a particular bitstream format typically comprises the adding of metadata to the encoded audio signal. As a result, a bitstream 305 of a particular format (e.g. an HE-AAC bitstream in the MP4 format) is obtained. This bitstream 305 typically comprises encoded data from the audio core encoder, as well as SBR encoder data and additional metadata.

The chromagram determination module 310 makes use of a time-frequency transformation 311 to determine a short term magnitude spectrum 101 of the audio signal 301. Subsequently, the sequence of chroma vectors (i.e. the chromagram 313) is determined in unit 312 from the sequence of short-term magnitude spectra 101.

FIG. 3 further illustrates an encoder 350, which comprises an integrated chromagram determination module. Some of the processing units of the combined encoder 350 correspond to the units of the separate encoder 300. However, as indicated above, the encoded bitstream 355 may be enhanced in the bitstream encoding unit 354 with additional metadata derived from the chromagram 353. On the other hand, the chromagram determination module may make use of the time-frequency transformation 302 of the encoder 350 and/or of the perceptual model 306 of the encoder 350. In other words, the chromagram computation 352 (possibly using psychoacoustic processing 356) may make use of the set of frequency coefficients X[k] provided by the transformation 302 to determine the magnitude spectrum 101 from which the chroma vector 100 is determined. Furthermore, the perceptual model 306 may be taken into account, in order to determine a perceptually salient chroma vector 100.

Figure 4:
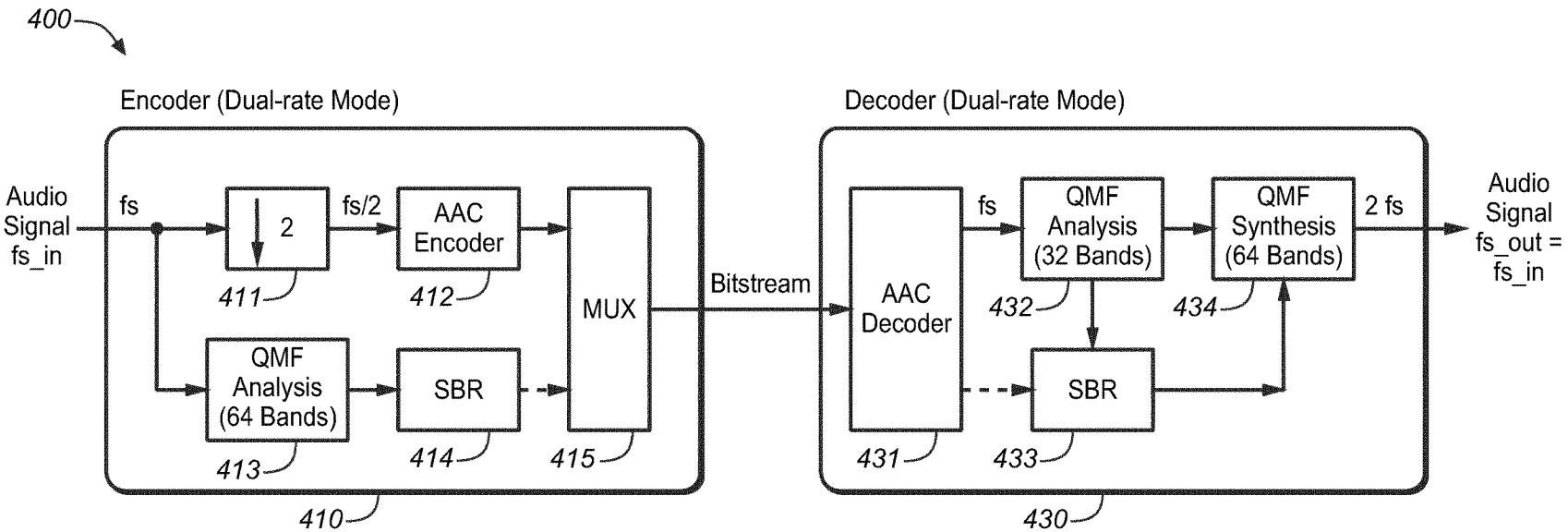
FIG. 4 shows a block diagram of an example High Efficiency—Advanced Audio Coding encoder and decoder.

FIG. 4 illustrates an example SBR based audio codec 400 used in HE-AAC version 1 and HE-AAC version 2 (i.e. HE-AAC comprising parametric stereo (PS) encoding/decoding of stereo signals). In particular, FIG. 4 shows a block diagram of an HE-AAC codec 400 operating in the so called dual-rate mode, i.e. in a mode where the core encoder 412 in the encoder 410 works at half the sampling rate than the SBR encoder 414. At the input of the encoder 410, an audio signal 301 at the input sampling rate fs=fs_in is provided. The audio signal 301 is downsampled by a factor two in the downsampling unit 411 in order to provide the low frequency component of the audio signal 301. Typically, the downsampling unit 411 comprises a low pass filter in order to remove the high frequency component prior to downsampling (thereby avoiding aliasing). The downsampling unit 411 provides a low frequency component at a reduced sampling rate fs/2=fs_in/2. The low frequency component is encoded by a core encoder 412 (e.g. an AAC encoder) to provide an encoded bitstream of the low frequency component.

The high frequency component of the audio signal is encoded using SBR parameters. For this purpose, the audio signal 301 is analyzed using an analysis filter bank 413 (e.g. a quadrature mirror filter bank (QMF) having e.g. 64 frequency bands). As a result, a plurality of subband signals of the audio signal is obtained, wherein at each time instant t (or at each sample k), the plurality of subband signals provides an indication of the spectrum of the audio signal 301 at this time instant t. The plurality of subband signals is provided to the SBR encoder 414. The SBR encoder 414 determines a plurality of SBR parameters, wherein the plurality of SBR parameters enables the reconstruction of the high frequency component of the audio signal from the (reconstructed) low frequency component at the corresponding decoder 430. The SBR encoder 414 typically determines the plurality of SBR parameters such that a reconstructed high frequency component that is determined based on the plurality of SBR parameters and the (reconstructed) low frequency component approximates the original high frequency component. For this purpose, the SBR encoder 414 may make use of an error minimization criterion (e.g. a mean square error criterion) based on the original high frequency component and the reconstructed high frequency component.

The plurality of SBR parameters and the encoded bitstream of the low frequency component are joined within a multiplexer 415 (e.g. the encoder unit 304) to provide an overall bitstream, e.g. an HE-AAC bitstream 305, which may be stored or which may be transmitted. The overall bitstream 305 also comprises information regarding SBR encoder settings, which were used by the SBR encoder 414 to determine the plurality of SBR parameters. In addition, it is proposed in the present document to add metadata derived from a chromagram 313, 353 of the audio signal 301 to the overall bitstream 305.

A corresponding decoder 430 may generate an uncompressed audio signal at the sampling rate fs_out=fs_in from the overall bitstream 305. The core decoder 431 separates the SBR parameters from the encoded bitstream of the low frequency component. Furthermore, the core decoder 431 (e.g. an AAC decoder) decodes the encoded bitstream of the low frequency component to provide a time domain signal of the reconstructed low frequency component at the internal sampling rate fs of the decoder 430. The reconstructed low frequency component is analyzed using an analysis filter bank 432. It should be noted that in the dual-rate mode the internal sampling rate fs is different at the decoder 430 from the input sampling rate fs_in and the output sampling rate fs_out, due to the fact that the AAC decoder 431 works in the downsampled domain, i.e. at an internal sampling rate fs which is half the input sampling rate fs_in and half the output sampling rate fs_out of the audio signal 301.

The analysis filter bank 432 (e.g. a quadrature mirror filter bank having e.g. 32 frequency bands) typically has only half the number of frequency bands compared to the analysis filter bank 413 used at the encoder 410. This is due to the fact that only the reconstructed low frequency component and not the entire audio signal has to be analyzed. The resulting plurality of subband signals of the reconstructed low frequency component are used in the SBR decoder 433 in conjunction with the received SBR parameters to generate a plurality of subband signals of the reconstructed high frequency component. Subsequently, a synthesis filter bank 434 (e.g. a quadrature mirror filter bank of e.g. 64 frequency bands) is used to provide the reconstructed audio signal in the time domain. Typically, the synthesis filter bank 434 has a number of frequency bands, which is double the number of frequency bands of the analysis filter bank 432. The plurality of subband signals of the reconstructed low frequency component may be fed to the lower half of the frequency bands of the synthesis filter bank 434 and the plurality of subband signals of the reconstructed high frequency component may be fed to the higher half of the frequency bands of the synthesis filter bank 434. The reconstructed audio signal at the output of the synthesis filter bank 434 has an internal sampling rate of 2fs which corresponds to the signal sampling rates fs_out=fs_in.

As such, the HE-AAC codec 400 provides a time-frequency transformation 413 for the determination of the SBR parameters. This time-frequency transformation 413 typically has, however, a very low frequency resolution and is therefore not suitable for chromagram determination. On the other hand, the core encoder 412, notably the AAC code encoder, also makes use of a time-frequency transformation (typically an MDCT) with a higher frequency resolution.

The AAC core encoder breaks an audio signal into a sequence of segments, called blocks or frames. A time domain filter, called a window, provides smooth transitions from block to block by modifying the data in these blocks. The AAC core encoder is adapted to dynamically switch between two block lengths: M=1028 samples and M=128 samples, referred to as long-blocks and short-blocks, respectively. As such, the AAC core encoder is adapted to encode audio signals that vacillate between tonal (steady-state, harmonically rich complex spectra signals) (using a long-block) and impulsive (transient signals) (using a sequence of eight short-blocks).

Figure 5:
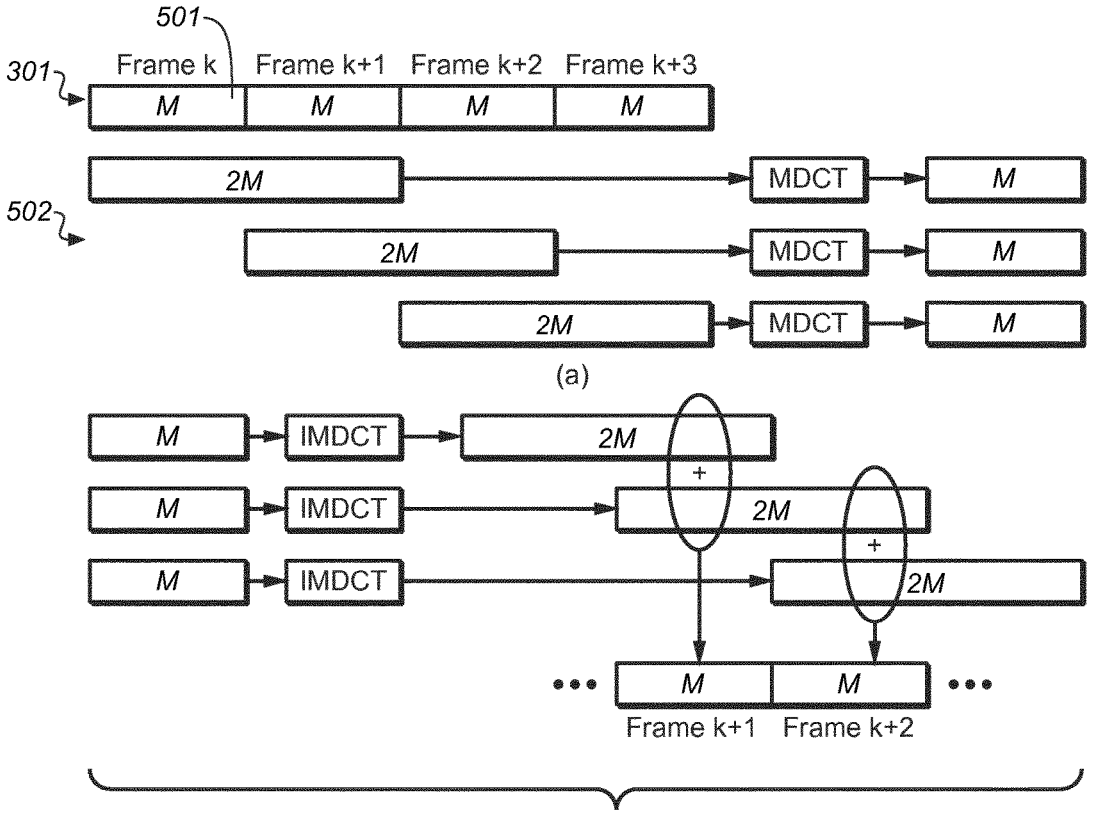
FIG. 5 illustrates the determination scheme of a Modified Discrete Cosine Transform.

Each block of samples is converted into the frequency domain using a Modified Discrete Cosine Transform (MDCT). In order to circumvent the problem of spectral leakage, which typically occurs in the context of block-based (also referred to as frame-based) time frequency transformations, MDCT makes use of overlapping windows, i.e. MDCT is an example of a so-called overlapped lapped transform. This is illustrated in FIG. 5, which shows an audio signal 301 comprising a sequence of frames or blocks 501. In the illustrated example, each block 501 comprises M samples of the audio signals 301 (with M=1024 for long-blocks and M=128 for short-blocks). Instead of applying the transform to only a single block, the overlapping MDCT transforms two neighboring blocks in an overlapping manner, as illustrated by the sequence 502. To further smoothen the transition between sequential blocks, a window function w[k] of length 2M is additionally applied. Because this window is applied twice, in the transform at the encoder and in the inverse transform at the decoder, the window function w[k] should fulfill the Princen-Bradley condition. The resulting MDCT transform can be written as $$X[k] = \sqrt{\frac{2}{M}} \sum_{l=0}^{2M-1} x[l]w[k]\cos\left[\frac{\pi}{4M}(2l+1+M)(2k+1)\right],$$

$$k \in [0, \ldots, M-1].$$

This means that M frequency coefficients X[k] are determined from 2M signal samples x[l].

Figure 6A:
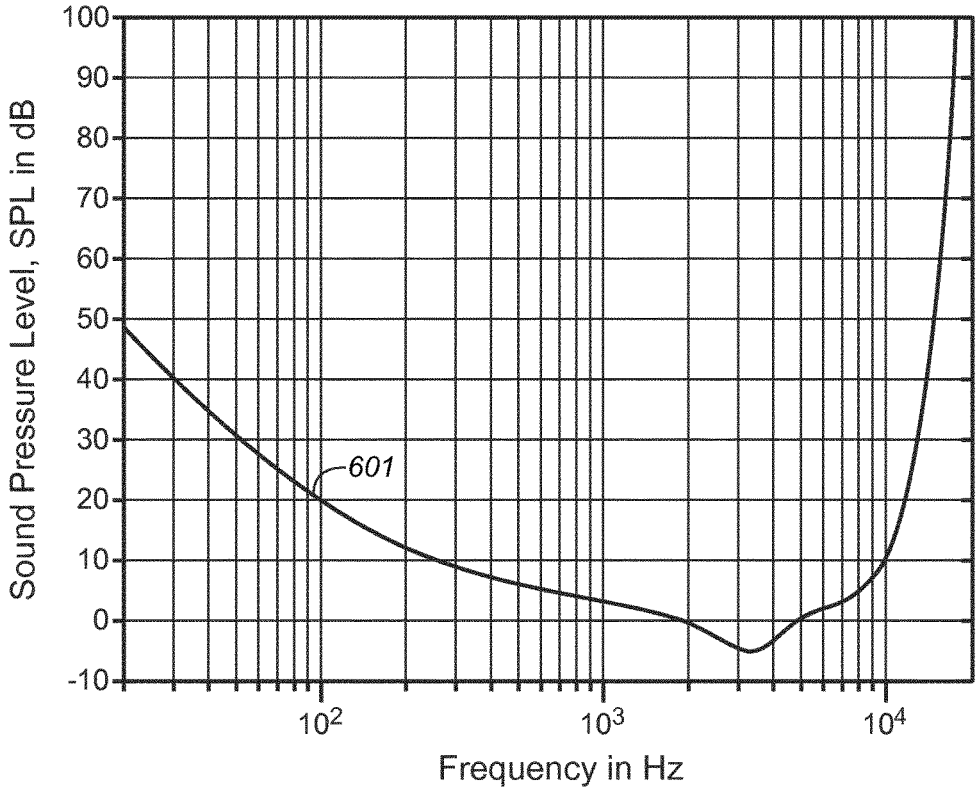
FIGS. 6*a* and *b* illustrate example psychoacoustic frequency curves.

Subsequently, the sequence of blocks of M frequency coefficients X[k] is quantized based on a psychoacoustic model. There are various psychoacoustic models used in audio coding, like the ones described in the standards ISO 13818-7:2005, Coding of Moving Pictures and Audio, 2005, or ISO 14496-3:2009, Information technology—Coding of audio-visual objects—Part3: Audio, 2009, or 3GPP, General Audio Codec audio processing functions; Enhanced aacPlus general audio codec; Encoder Specification AAC part, 2004, which are incorporated by reference. The psychoacoustic models typically take into account the fact that the human ear has a different sensitivity for different frequencies. In other words, the sound pressure level (SPL) required for perceiving an audio signal at a particular frequency varies as a function of frequency. This is illustrated in FIG. 6*a* where the threshold of hearing curve 601 of a human ear is illustrated as a function of frequency. This means that frequency coefficients X[k] can be quantized under consideration of the threshold of hearing curve 601 illustrated in FIG. 6*a*.

Figure 6B:
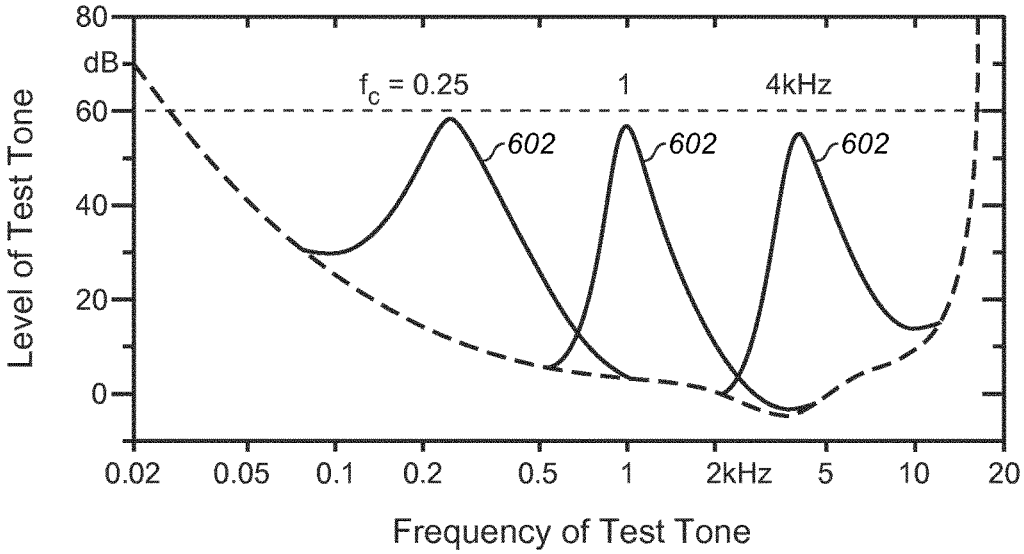

In addition, it should be noted that the capacity of hearing of the human ear is subjected to masking. The term masking may be subdivided into spectral masking and temporal masking Spectral masking indicates that a masker tone at a certain energy level in a certain frequency interval may mask other tones in the direct spectral neighborhood of the frequency interval of the masker tone. This is illustrated in FIG. 6*b*, where it can be observed that the threshold of hearing 602 is increased in the spectral neighborhood of narrowband noise at a level of 60 dB around the center frequencies of 0.25 kHz, 1 kHz and 4 kHz, respectively. The elevated threshold of hearing 602 is referred to as the masking threshold Thr. This means that frequency coefficients X[k] can be quantized under consideration of the masking threshold 602 illustrated in FIG. 6*b*. Temporal masking indicates that a preceding masker signal may mask a subsequent signal (referred to as post-masking or forward masking) and/or that a subsequent masker signal may mask a preceding signal (referred to as pre-masking or backward masking).

By way of example, the psychoacoustic model from the 3GPP standard may be used. This model determines an appropriate psychoacoustic masking threshold by calculating a plurality of spectral energies $X_{en}$ for a corresponding plurality of frequency bands b. The plurality of spectral energies $X_{en}[b]$ for a subband b (also referred to as frequency band b in the present document and also referred to as scale factor band in the context of HE-AAC) may be determined from the MDCT frequency coefficients X[k] by summing the squared MDCT coefficients, i.e. as $$X_{en}[b] = \sum_{k=k1}^{k2} X^2[k]$$

using a constant offset simulates a worst-case scenario, namely a tonal signal for the whole audio frequency range. In other words, the psychoacoustic model makes no distinction between tonal and non-tonal components. All signal frames are assumed to be tonal, which implies a "worst-case" scenario. As a result, tonal and non-tonal component distinction is not performed, and hence this psychoacoustic model is computationally efficient.

The used offset value corresponds to a SNR (signal-to-noise ratio) value, which should be chosen appropriately to guarantee high audio quality. For standard AAC, a logarithmic SNR value of 29 dB is defined and the threshold in the subband b is determined as $$Thr_{sc}[b] = \frac{X_{en}[b]}{SNR}.$$

The 3GPP model simulates the auditory system of a human by comparing the threshold $Thr_{sc}[b]$ in the subband b with a weighted version of the threshold $Thr_{sc}[b-1]$ or $Thr_{sc}[b+1]$ of the neighboring subbands b−1, b+1 and by selecting the maximum. The comparison is done using different frequency-dependent weighting coefficients $s_h[b]$ and $s_l[b]$ for the lower neighbor and for the higher neighbor, respectively, in order to simulate the different slopes of the asymmetric masking curve 602. Consequently, a first filtering operation, starting at the lowest subband and approximating a slope of 15 dB/Bark, is given by $$Thr'_{spr}[b] = \max(Thr_{sc}[b], s_h[b] \cdot Thr_{sc}[b-1]),$$

and a second filtering operation, starting at the highest subband and approximating a slope of 30 dB/Bark, is given by $$Thr_{spr}[b] = \max(Thr'_{spr}[b], s_l[b] \cdot Thr'_{spr}[b+1]).$$

In order to obtain the overall threshold Thr[b] for the subband b from the calculated masking threshold $Thr_{spr}[b]$, also the threshold in quiet 601 (referred to as $Thr_{quiet}[b]$) should be taken into account. This may be done by selecting the higher value of the two masking thresholds for each subband b, respectively, such that the more dominant part of the two curves is taken into account. This means that the overall masking threshold may be determined as $$Thr'[b] = \max(Thr_{spr}[b], Thr_{quiet}[b]).$$

Furthermore, in order to make the overall masking threshold Thr'[b] more resistant to the problem of pre-echoes, the following additional modification may be applied. When a transient signal occurs, it is likely that there is a sudden increase or drop of energy in some subbands b from one block to another. Such jumps of energy may lead to a sudden increase of the masking threshold Thr'[b] which would lead to a sudden reduction of the quantization quality. This could lead to audible errors in the encoded audio signal in form of pre-echo artifacts. As such, the masking threshold may be smoothed along the time axis by selecting the masking threshold Thr[b] for a current block as a function of the masking threshold $Thr_{last}[b]$ of a previous block. In particular, the masking threshold Thr[b] for a current block may be determined as $$Thr[b] = \max(rpmn \cdot Thr_{spr}[b], \min(Thr'[b], rpelev \cdot Thr_{last}[b])),$$

wherein rpmn, rpelv are appropriate smoothening parameters. This reduction of the masking threshold for transient signals causes higher SMR (Signal to Marking Ratio) values, resulting in a better quantization, and ultimately in less audible errors in form of pre-echo artifacts.

The masking threshold Thr[b] is used within the quantization and coding unit 303 for quantizing MDCT coefficients of a block 501. A MDCT coefficient which lies below the masking threshold Thr[b] is quantized and coded less accurately, i.e. less bits are invested. The masking threshold Thr[b] can also be used in the context of perceptual processing 356 prior to (or in the context of) chromagram computation 352, as will be outlined in the present document.

Overall, it may be summarized that the core encoder 412 provides:

- a representation of the audio signal 301 in the time-frequency domain, in the form of a sequence of MDCT coefficients (for long-blocks and for short-blocks); and
- a signal dependent perceptual model in the form of a frequency (subband) dependent masking threshold Thr [b] (for long-blocks and for short-blocks).

This data can be used for the determination of a chromagram 353 of the audio signal 301. For long-blocks (M=1024 samples), the MDCT coefficients of a block typically have a sufficiently high frequency resolution for determining a chroma vector. Since the AAC core codec 412 in an HE-AAC encoder 410 operates at half the sampling frequency, the MDCT transform-domain representations used in HE-AAC have an even better frequency resolution for long-blocks than in the case of AAC without SBR encoding. By way of example, for an audio signal 301 at a sampling rate of 44.1 kHz, the frequency resolution of the MDCT coefficients for a long-block is Δf=10.77 Hz/bin, which is sufficiently high for determining a chroma vector for most Western popular music. In other words, the frequency resolution of long-blocks of the core encoder of an HE-AAC encoder is sufficiently high, in order to reliably assign the spectral energy to the different tone classes of a chroma vector (see FIG. 1 and Table 1).

On the other hand, for short-blocks (M=128), the frequency resolution is Δf=86.13 Hz/bin. As the fundamental frequencies (F0s) are not spaced by more than 86.13 Hz apart until the $6^{th}$ octave, the frequency resolution provided by short-blocks is typically not sufficient for the determination of a chroma vector. Nevertheless, it may be desirable to also be able to determine a chroma vector for short-blocks, as the transient audio signal, which is typically associated with a sequence of short-blocks, may comprise tonal information (e.g. from a Xylophone or a Glockenspiel or a techno musical genre). Such tonal information may be important for reliable MIR applications.

In the following, various example schemes for increasing the frequency resolution of a sequence of short-blocks are described. These example schemes have reduced computational complexity compared to the transformation of the original time domain audio signal block into the frequency domain. This means, these example schemes allow the determination of a chroma vector from the sequence of short-blocks at reduced computational complexity (compared to the determination directly from the time domain signal).

As outlined above, an AAC encoder typically selects a sequence of eight short-blocks instead of a single long-block in order to encode a transient audio signal. As such, a sequence of eight MDCT coefficient blocks $X_l[k]$, 1=0, . . . , N−1, with N=8 in the case of AAC, is provided. A first scheme for increasing the frequency resolution of short-block spectra may be to concatenate N frequency coefficient blocks $X_1$ to $X_N$ of length $M_{short}$ (=128), and to interleave the frequency coefficients. This short-block interleaving scheme (SIS) rearranges the frequency coefficients according to their time index, to a new block $X_{SIS}$ of length $M_{long}=NM_{short}$ (=1024). This may be done according to $$X_{SIS}[kN+l]=X_l[k], k\in[0, \ldots, M_{short}-1], l\in[0, \ldots, N-1]$$

This interleaving of frequency coefficients increases the number of frequency coefficients, thus increasing the resolution. But since N low-resolution coefficients of the same frequency, at different points in time, are mapped to N high-resolution coefficients of different frequencies, at the same point in time, an error with a variance of ±N/2 bins is introduced. Nevertheless, in the case of HE-AAC or AAC, this method allows to estimate a spectrum with $M_{long}$=1024 coefficients by interleaving the coefficients of N=8 short-blocks with a length of $M_{short}$=128.

A further scheme for increasing the frequency resolution of a sequence of N short-blocks is based on the adaptive hybrid transform (AHT). The AHT exploits the fact that if a time signal remains relatively constant, its spectrum will typically not change rapidly. The decorrelation of such a spectral signal will lead to a compact representation in the low frequency bins. A transform for decorrelating signals may be the DCT-II (Discrete Cosine Transform) which approximates the Karhunen-Loeve-Transform (KLT). The KLT is optimal in the sense of decorrelation. However, the KLT is signal dependent and therefore not applicable without high complexity. The following formula of the AHT can be seen as the combination of the above-mentioned SIS and a DCT-II kernel for decorrelating the frequency coefficients of corresponding short-block frequency bins:

$$X_{AHT}[kN+l]=\frac{\sqrt{2}}{N}C_l\sum_{m=0}^{N-1}X_m[k]\cos\left(\frac{(2m+1)l\pi}{2N}\right),$$

$$k\in[0, \ldots, M_{short}-1], l\in[0, \ldots, N-1], C_l=\begin{cases}\frac{1}{\sqrt{2}} & l=0\\ 1 & \text{else.}\end{cases}$$

The block of frequency coefficients $X_{AHT}$ has an increased frequency resolution, with a reduced error variance compared to the SIS. At the same time, the computational complexity of the AHT scheme is lower compared to a complete MDCT of the long-block of audio signal samples.

As such, the AHT may be applied over the N=8 short-blocks of a frame (that is equivalent to a long-block) to estimate a high-resolution long-block spectrum. The quality of resulting chromagrams thereby benefits from the approximation of a long-block spectrum, instead of using a sequence of short-block spectra. It should be noted that in general, the AHT scheme could be applied to an arbitrary number of blocks because the DCT-II is a non-overlapping transform. Therefore, it is possible to apply the AHT scheme to subsets of a sequence of short-blocks. This may be beneficial to adapt the AHT scheme to the particular conditions of the audio. By way of example, one could distinguish a plurality of different stationary entities within a sequence of short-blocks by computing a spectral similarity measure and by segmenting the sequence of short-blocks into different subsets. These subsets can then be processed with the AHT to increase the frequency resolution of the subsets.

A further scheme for increasing the frequency resolution of a sequence of MDCT coefficient blocks $X_l[k]$, 1=0, . . . , N−1 is to use a polyphase description of the underlying MDCT transformation of the sequence of short-blocks and the MDCT transformation of the long-block. By doing this, a conversion matrix Y can be determined which performs an exact transformation of the sequence of MDCT coefficient blocks $X_l[k]$, 1=0, . . . , N−1 (i.e. the sequence of short-blocks) to the MDCT coefficient block for a long-block, i.e.

$$X_{PPC}=Y\cdot[X_0, \ldots, X_{N-1}],$$

wherein $X_{PPC}$ is a [3, MN] matrix representing the MDCT coefficients of a long-block and the influence of the two preceding frames, Y is the [MN,MN,3] conversion matrix (wherein the third dimension of the matrix Y represents the fact that the coefficients of the matrix Y are $3^{rd}$ order polynomials, meaning that the matrix elements are equations described by $az^{-2}+b\,z^{-1}+c\,z^{-0}$, where z represents a delay of one frame) and $[X_0, \ldots, X_{N-1}]$ is an [1, MN] vector formed of the MDCT coefficients of the N short-blocks. N is the number of short-blocks forming a long-block with length N×M and M is the number of samples within a short-block.

The conversion matrix Y is determined from a synthesis matrix G for transforming the N short-blocks back into the time domain and an analysis matrix H for transforming the time domain samples of a long-block into the frequency domain, i.e. Y=G·H. The conversion matrix Y allows a perfect reconstruction of the long-block MDCT coefficients from the N sets of short-block MDCT coefficients. It can be shown that the conversion matrix Y is sparse, which means that a significant fraction of the matrix coefficients of the conversion matrix Y can be set to zero without significantly affecting the conversion accuracy. This is due to the fact that both matrices G and H comprise weighted DCT-IV transform coefficients. The resulting conversion matrix Y=G·H is a sparse matrix, because the DCT is an orthogonal transformation. Therefore many of the coefficients of the conversion matrix Y can be disregarded in the calculation, as they are nearly zero. Typically, it is sufficient to consider a band of q coefficients around the main diagonal. This approach makes the complexity and the accuracy of the conversion from short-blocks to long-blocks scalable as q can be chosen from 1 to M×N. It can be shown that the complexity of the conversion is O(q·M·N·3) compared to the complexity of a long-block MDCT of $O((MN)^2)$ or O(M·N·log(M·N)) in a recursive implementation. This means that the conversion using a polyphase conversion matrix Y may be implemented at a lower computational complexity than the recalculation of an MDCT of the long-block.

The details regarding the polyphase conversion are described in G. Schuller, M. Gruhne, and T. Friedrich, "Fast audio feature extraction from compressed audio data", Selected Topics in Signal Processing, IEEE Journal of, 5(6):1262-1271, October 2011, which is incorporated by reference.

As a result of the polyphase conversion, an estimate of the long-block MDCT coefficients $X_{PPC}$ is obtained, which provides N times higher frequency resolution than the short-block MDCT coefficients $[X_0, \ldots, X_{N-1}]$. This means that the estimated long-block MDCT coefficients $X_{PPC}$ typically have a sufficiently high frequency resolution for the determination of a chroma vector.

FIGS. 7*a* to *e* show example spectrograms of an audio signal comprising distinct frequency components as can be seen from the spectrogram 700 based on the long-block MDCT. As can be seen from the spectrogram 701 shown FIG. 7*b*, the spectrogram 700 is well approximated by the estimated long-block MDCT coefficients $X_{PPC}$. In the illustrated example, q=32, i.e. only 3% of the coefficients of the conversion matrix Y are taken into consideration. This means that the estimate of the long-block MDCT coefficients $X_{PPC}$ can be determined at significantly reduced computational complexity.

Figure 7A:
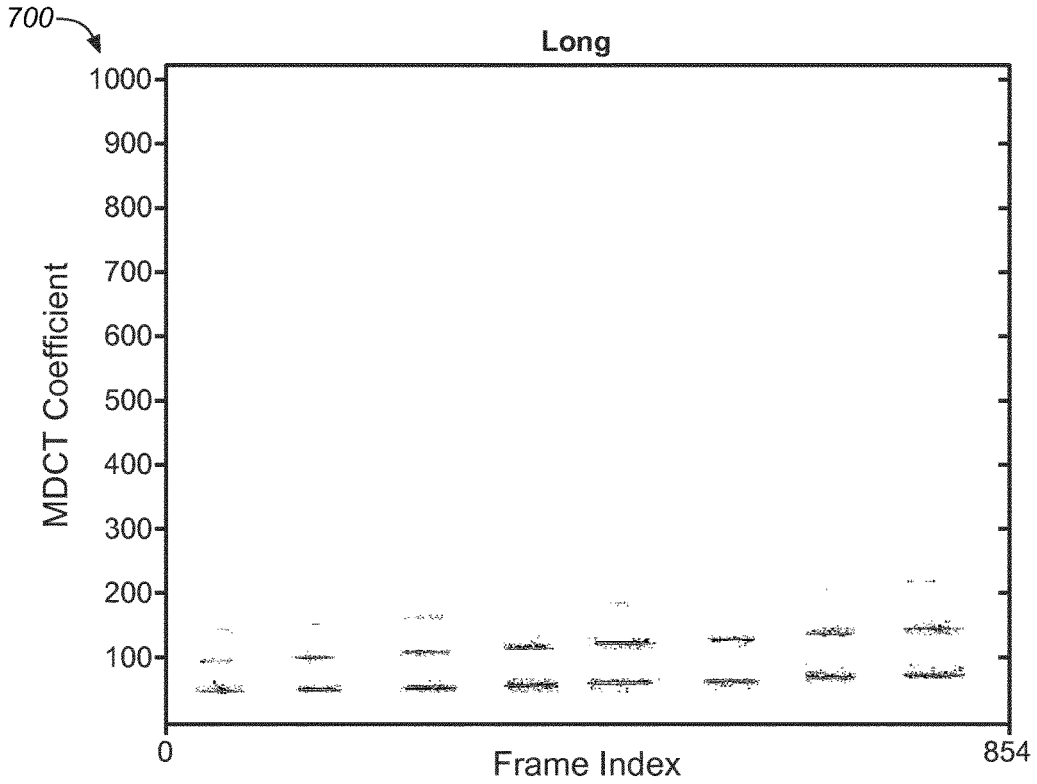
FIGS. 7*a* to *e* show example sequences of (estimated) long-blocks of frequency coefficients.
Figure 7B:
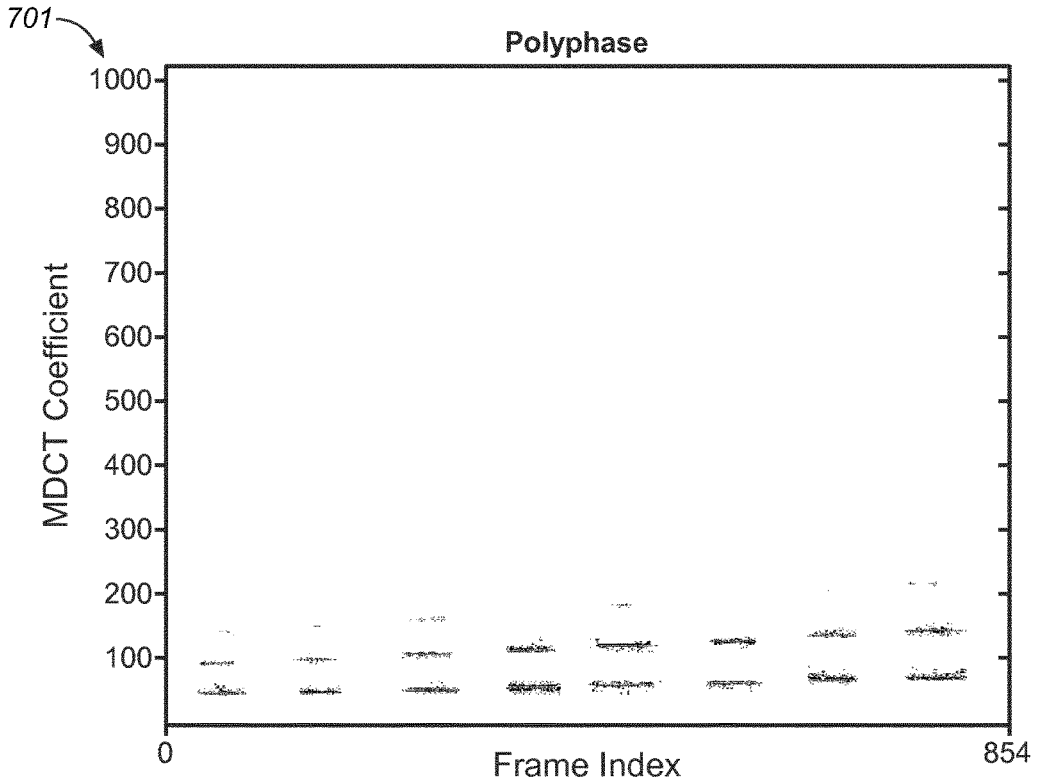
Figure 7C:
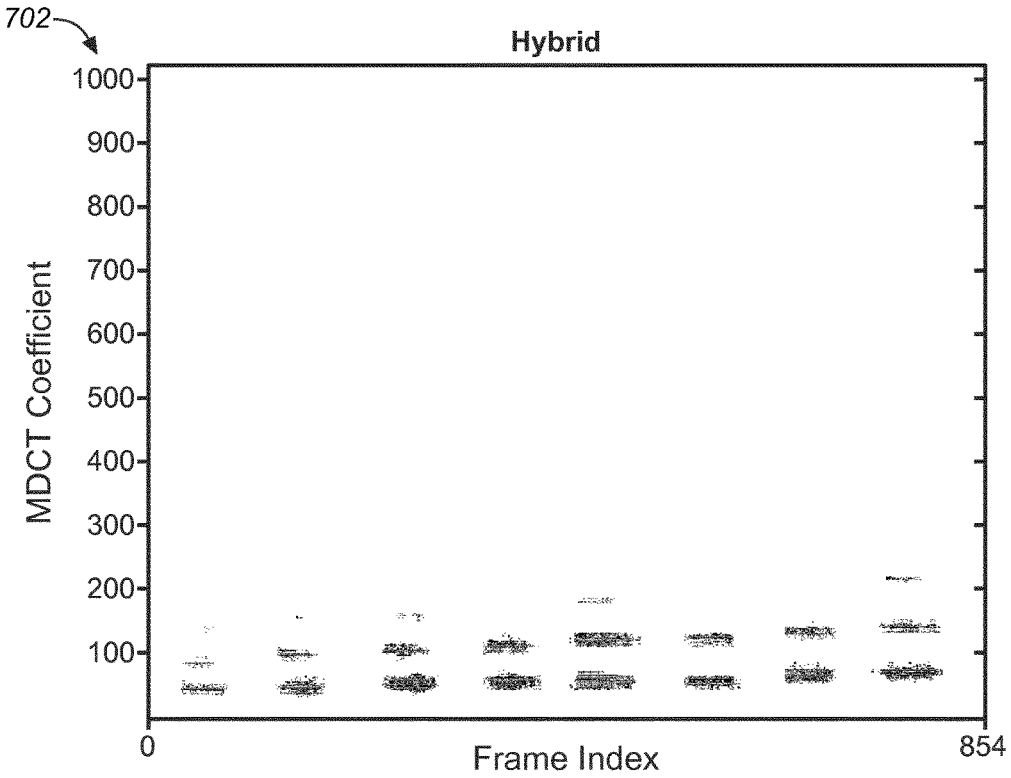
Figure 7D:
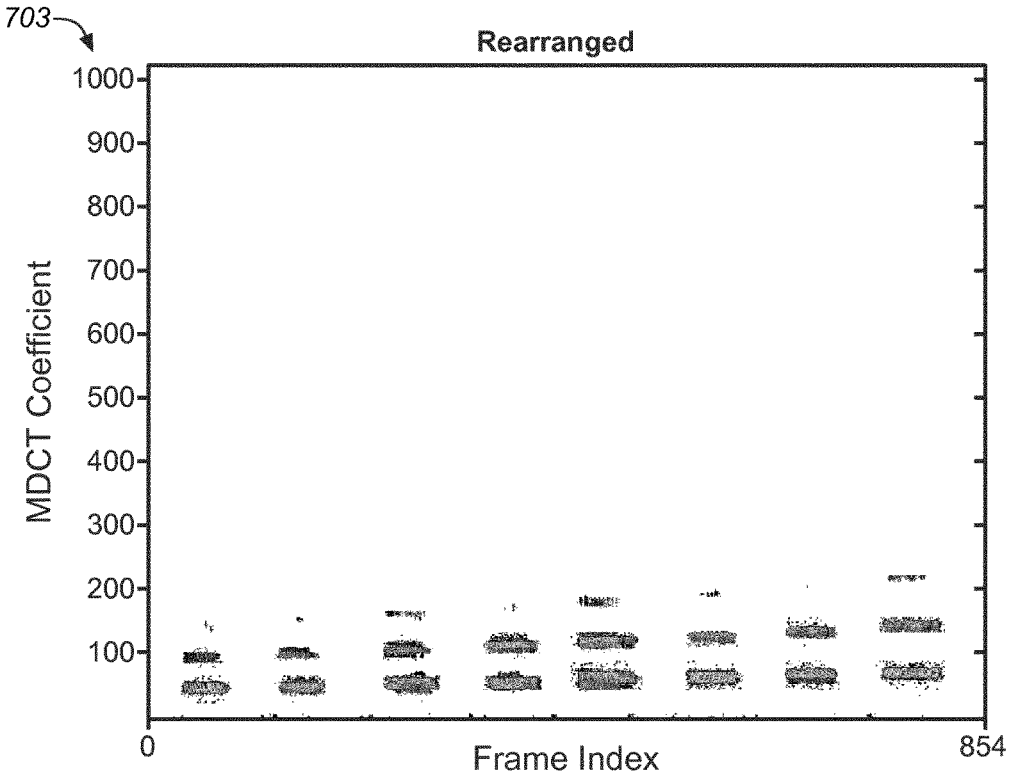
Figure 7E:
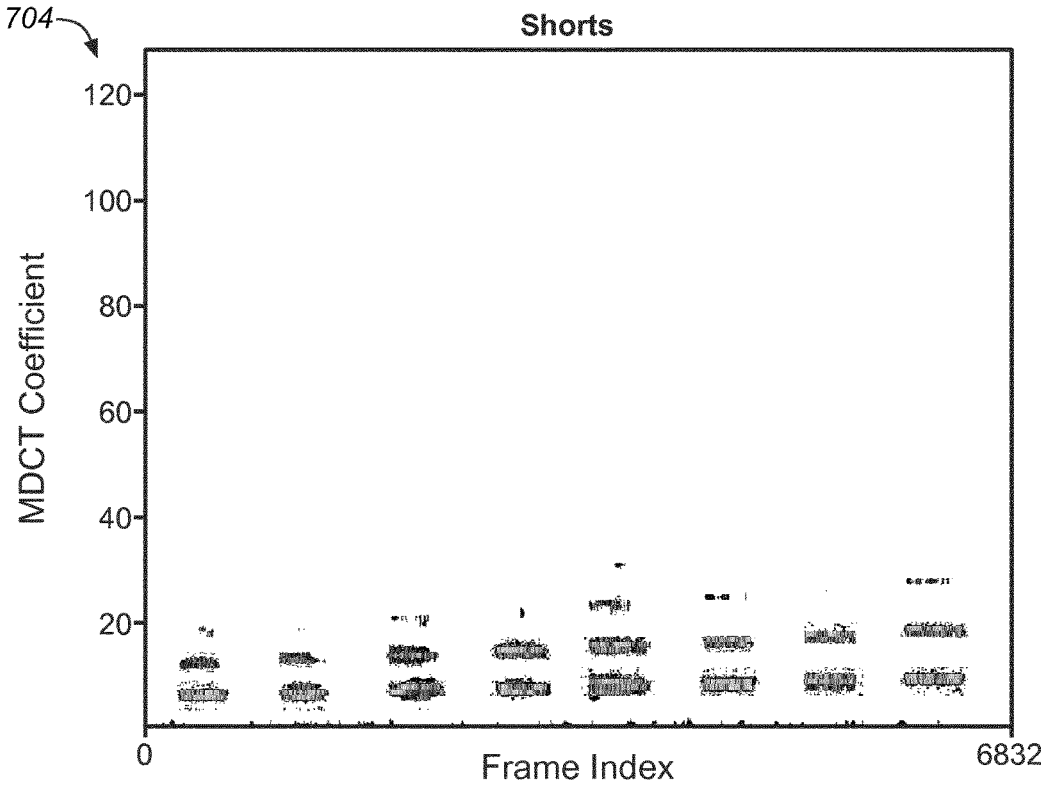

FIG. 7*c* illustrates the spectrogram 702 which is based on the estimated long-block MDCT coefficients $X_{AHT}$. It can be observed that the frequency resolution is lower than the frequency resolution of the correct long-block MDCT coefficients illustrated in the spectrogram 700. At the same time, it can be seen that the estimated long-block MDCT coefficients $X_{AHT}$ provide a higher frequency resolution than the estimated long-block MDCT coefficients $X_{ms}$ illustrated in spectrogram 703 of FIG. 7*d* which itself provides a higher frequency resolution than the short-block MDCT coefficients $[X_0, \ldots, X_{N-1}]$ illustrated by the spectrogram 704 of FIG. 7*e*.

Figure 8:
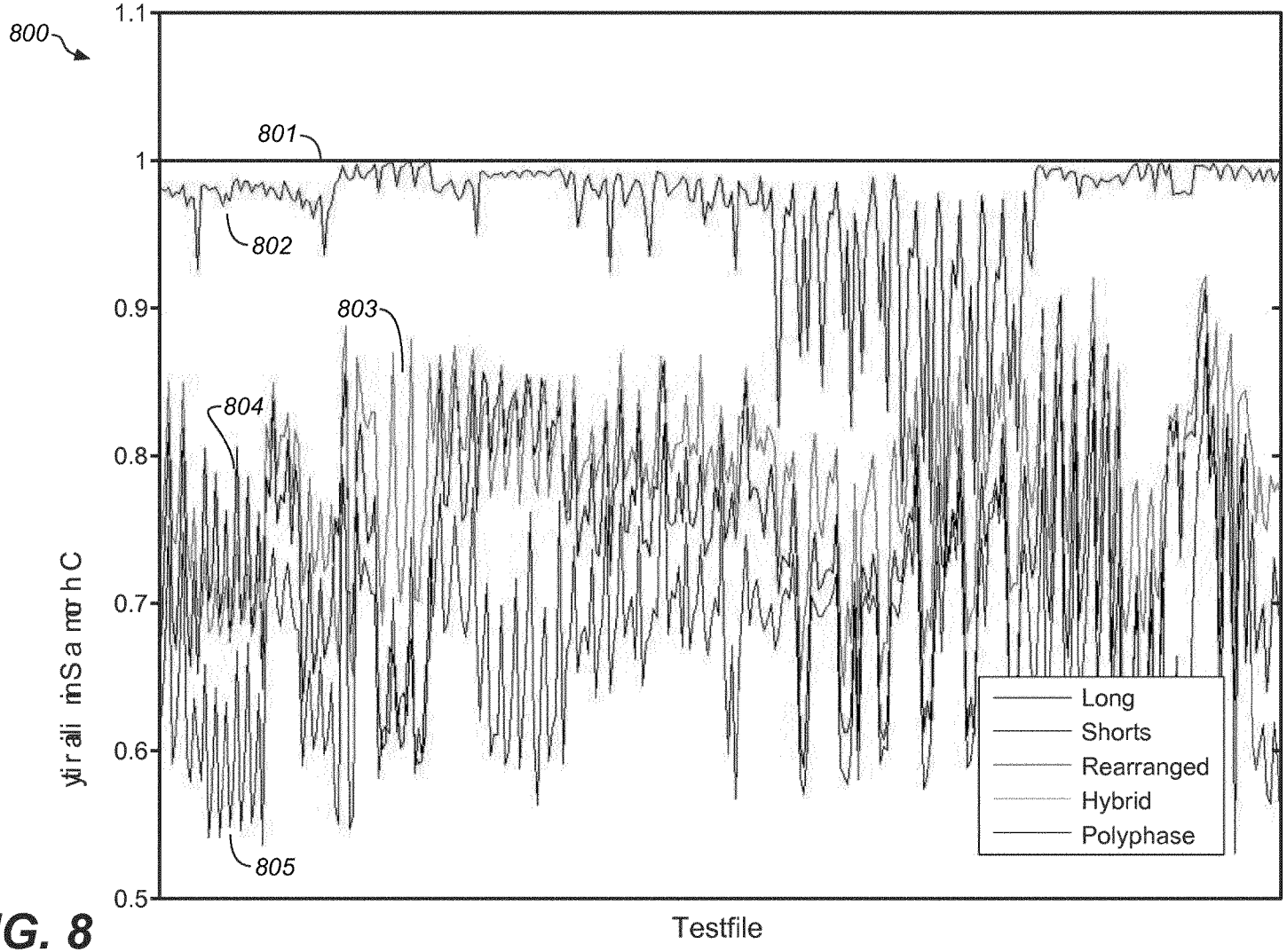
FIG. 8 shows example experimental results for the similarity of chroma vectors derived from various long-block estimation schemes.

The different frequency resolution provided by the various short-block to long-block conversion schemes outlined above is also reflected in the quality of the chroma vectors determined from the various estimates of the long-block MDCT coefficients. This is shown in FIG. 8, which shows the mean chroma similarity for a number of test files. The chroma similarity may e.g. indicate the mean square deviation of a chroma vector obtained from the long-block MDCT coefficients compared to the chroma vector obtained from the estimated long-block MDCT coefficients. Reference numeral 801 indicates the reference of chroma similarity. It can be seen that the estimate determined based on polyphase conversion has a relatively high degree of similarity 802. The polyphase conversion was performed with q=32, i.e. with 3% of the full conversion complexity. Furthermore, the degree of similarity 803 achieved with the Adaptive Hybrid Transform, the degree of similarity 804 achieved with the Short-Block Interleaving scheme and the degree of similarity 805 achieved based on the short-blocks is illustrated.

As such, methods have been described which allow the determination of a chromagram based on the MDCT coefficients provided by an SBR based core encoder (e.g. an AAC core encoder). It has been outlined how the resolution of a sequence of short-block MDCT coefficients can be increased by approximating the corresponding long-block MDCT coefficients. The long-block MDCT coefficients can be determined at reduced computational complexity compared to a recalculation of the long-block MDCT coefficients from the time domain. As such, it is possible to also determine chroma vectors for transient audio signals at reduced computational complexity.

In the following, methods for perceptually enhancing chromagrams are described. In particular, methods that make use of the perceptual model provided by an audio encoder are described.

As has already been outlined above, the purpose of the psychoacoustic model in a perceptual and lossy audio encoder is typically to determine how fine certain parts of the spectrum are to be quantized depending on a given bit rate. In other words, the psychoacoustic model of the encoder provides a rating for the perceptual relevance for every frequency band b. Under the premise, that the perceptually relevant parts mainly comprise harmonic content, the application of the masking threshold should increase the quality of the chromagrams. Chromagrams for polyphonic signals should especially benefit, since noisy parts of the audio signal are disregarded or at least attenuated.

It has already been outlined how a frame-wise (i.e. block-wise) masking threshold Thr[b] may be determined for the frequency band b. The encoder uses this masking threshold, by comparing the masking threshold Thr[b] for every frequency coefficient X[k] with the energy $X_{en}[b]$ of the audio signal in the frequency band b (which is also referred to as a scale factor band in the case of HE-AAC) which comprises the frequency index k. Whenever the energy value $X_{en}[b]$ falls below the masking value, X[k] is disregarded, i.e. $X[k]=0 \forall X_{en}[b]<Thr[b]$. Typically, a coefficient-wise comparison of the frequency coefficients (i.e. energy values) X[k] with the masking threshold Thr[b] of the corresponding frequency band b only provides minor quality benefits over a band-wise comparison within a chord recognition application based on the chromagrams determined according to the methods described in the present document. On the other hand, a coefficient-wise comparison would lead to increased computational complexity. As such, a block-wise comparison using average energy values $X_{en}[b]$ per frequency band b may be preferable.

Typically, the energy of a frequency band b (also referred to as scale factor band energy) which comprises a harmonic contributor should be higher than the perceptual masking threshold Thr[b]. On the other hand, the energy of a frequency band b which mainly comprises noise should be smaller than the masking threshold Thr[b]. As such, the encoder provides a perceptually motivated, noise reduced version of the frequency coefficients X[k] which can be used to determine a chroma vector for a given frame (and a chromagram for a sequence of frames).

Alternatively, a modified masking threshold may be determined from the data available at the audio encoder. Given the scale factor band energy distribution $X_{en}[b]$ for a particular block (or frame), a modified masking threshold $Thr_{constSMR}$ may be determined using a constant SMR (Signal-to-Mask-Ratio) for all scale factor bands b, i.e. $Thr_{constSMR}[b]=X_{en}[b]-SMR$. This modified masking threshold can be determined at low computational costs, as it only requires subtraction operations. Furthermore, the modified masking threshold strictly follows the energy of the spectrum, such that the amount of disregarded spectral data can be easily adjusted by adjusting the SMR value of the encoder.

It should be noted that the SMR of a tone may be dependent on the tone amplitude and tone frequency. As such, alternatively to the above mentioned constant SMR, the SMR may be adjusted/modified based on the scale factor band energy $X_{en}[b]$ and/or the band index b.

Furthermore, it should be noted that the scale factor band energy distribution $X_{en}[b]$ for a particular block (frame) can be received directly from the audio encoder. The audio encoder typically determines this scale factor band energy distribution $X_{en}[b]$ in the context of (psychoacoustic) quantization. The method for determining a chroma vector of a frame may receive the already computed scale factor band energy distribution $X_{en}[b]$ from the audio encoder (instead of computing the energy values) in order to determine the above mentioned masking threshold, thereby reducing the computational complexity of chroma vector determination.

The modified masking threshold may be applied by setting $X[k]=0 \forall X[k]<Thr[b]$. If it is assumed that there is only one harmonic contributor per scale factor band b, the energy $X_{en}[b]$ in this band b and the coefficient X[k] of the energy spectrum should have similar values. Therefore, a reduction of $X_{en}[b]$ by a constant SMR value should yield a modified masking threshold which will catch only the harmonic parts of the spectrum. The non-harmonic part of the spectrum should be set to zero. The chroma vector of a frame (and the chromagram of a sequence of frames) may be determined from the modified (i.e. perceptually processed) frequency coefficients.

Figure 9:
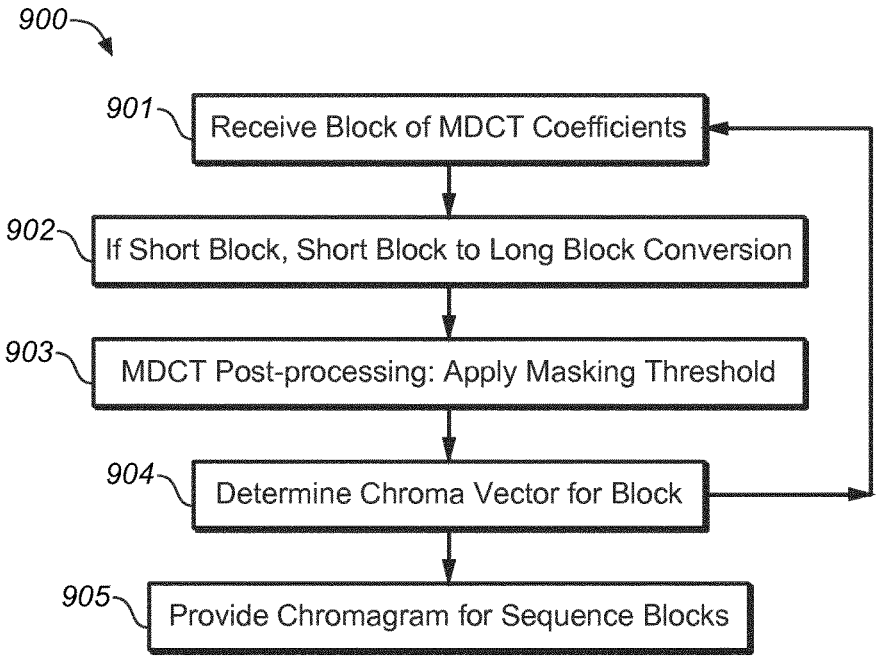
FIG. 9 shows an example flow chart of a method for determining a sequence of chroma vectors for an audio signal.

FIG. 9 illustrates a flow chart of an example method 900 for determining a sequence of chroma vectors from a sequence of blocks of an audio signal. In step 901, a block of frequency coefficients (e.g. MDCT coefficients) is received. This block of frequency coefficients is received from an audio encoder, which has derived the block of frequency coefficients from a corresponding block of samples of the audio signal. In particular, the block of frequency coefficients may have been derived by a core encoder of an SBR based audio encoder from a (downsampled) low frequency component of the audio signal. If the block of frequency coefficients corresponds to a sequence of short-blocks, the method 900 performs a short-block to long-block transformation scheme outlined in the present document (step 902) (e.g. the SIS, AHT or PPC scheme). As a result, an estimate for a long-block of frequency coefficients is obtained. Optionally, the method 900 may submit the (estimated) block of frequency coefficients to a psychoacoustic, frequency dependent threshold, as outlined above (step 903). Subsequently, a chroma vector is determined from the resulting long-block of frequency coefficients (step 904). If this method is repeated for a sequence of blocks, a chromagram of the audio signal is obtained (step 905).

In the present document, various methods and systems for determining a chroma vector and/or a chromagram at reduced computational complexity are described. In particular, it is proposed to make use of the time-frequency representation of an audio signal, which is provided by audio codecs (such as the HE-AAC codec). In order to provide a continuous chromagram (also for transient parts of the audio signal where the encoder has switched to short blocks, desirably or undesirably), methods for increasing the frequency resolution of short-block time-frequency representations are described. In addition, it is proposed to make use of the psychoacoustic model provided by the audio codec, in order to improve the perceptual salience of the chromagram.

It should be noted that the description and drawings merely illustrate the principles of the proposed methods and systems. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the proposed methods and systems and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The methods and systems described in the present document may be implemented as software, firmware and/or hardware. Certain components may e.g. be implemented as software running on a digital signal processor or microprocessor. Other components may e.g. be implemented as hardware and or as application specific integrated circuits. The signals encountered in the described methods and systems may be stored on media such as random access memory or optical storage media. They may be transferred via networks, such as radio networks, satellite networks, wireless networks or wireline networks, e.g. the Internet. Typical devices making use of the methods and systems described in the present document are portable electronic devices or other consumer equipment which are used to store and/or render audio signals.

The invention claimed is:

1. A method for processing a block of samples of an audio signal, the method being performed at a spectral band replication based audio encoder which includes a core encoder adapted to derive a block of frequency coefficients from the block of samples of the audio signal and to generate an encoded bitstream of the audio signal from the block of frequency coefficients, and the method comprising:

receiving the block of frequency coefficients from the core encoder of the spectral band replication based audio encoder;

determining a chroma vector for the block of samples of the audio signal based on the received block of frequency coefficients, wherein determining the chroma vector comprises applying frequency dependent psychoacoustic processing to the received block of frequency coefficients or to one or more frequency coefficients which are determined on the basis of the received block of frequency coefficients;

determining melodic and/or harmonic content of the block of samples of the audio signal based on the chroma vector for the block of samples of the audio signal; and storing the melodic and/or harmonic content on media or transferring the melodic and/or harmonic content via a network.

2. The method of claim 1, wherein the block of samples of the audio signal comprises N succeeding short-blocks of M samples each, respectively;

the received block of frequency coefficients comprises N corresponding short-blocks of M frequency coefficients each, respectively, and wherein the method further comprises:

estimating a long-block of frequency coefficients corresponding to the block of samples of the audio signal from the N short-blocks of M frequency coefficients; wherein the estimated long-block of frequency coefficients has an increased frequency resolution compared to the N short-blocks of frequency coefficients; and determining the chroma vector for the block of samples of the audio signal based on the estimated long-block of frequency coefficients.

3. The method of claim 2, wherein estimating the long-block of frequency coefficients comprises interleaving corresponding frequency coefficients of the N short-blocks of frequency coefficients, thereby yielding an interleaved long-block of frequency coefficients.

4. The method of claim 3, wherein estimating the long-block of frequency coefficients comprises decorrelating the N corresponding frequency coefficients of the N short-blocks of frequency coefficients by applying a transform with energy compaction property to the interleaved long-block of frequency coefficients.

5. The method of claim 2, wherein estimating the long-block of frequency coefficients comprises:

forming a plurality of sub-sets of the N short-blocks of frequency coefficients; wherein the number of short-blocks per sub-set is selected based on the audio signal;

for each sub-set, interleaving corresponding frequency coefficients of the short-blocks of frequency coefficients, thereby yielding an interleaved intermediate-block of frequency coefficients of the sub-set; and for each sub-set, applying a transform with energy compaction property, e.g. a DCT-II transform, to the interleaved intermediate-block of frequency coefficients of the sub-set, thereby yielding a plurality of estimated intermediate-blocks of frequency coefficients for the plurality of sub-sets.

6. The method of claim 5, wherein the frequency dependent psychoacoustic processing is applied to one of the plurality of estimated intermediate-blocks of frequency coefficients.

7. The method of claim 2, wherein estimating the long-block of frequency coefficients comprises applying a polyphase conversion to the N short-blocks of M frequency coefficients, wherein the polyphase conversion is based on a conversion matrix for mathematically transforming the N short-blocks of M frequency coefficients to an accurate long-block of N×M frequency coefficients; and the polyphase conversion makes use of an approximation of the conversion matrix with a fraction of conversion matrix coefficients set to zero.

8. The method of claim 2, wherein estimating the long-block of frequency coefficients comprises:

forming a plurality of sub-sets of the N short-blocks of frequency coefficients; wherein the number L of short-blocks per sub-set is selected based on the audio signal, $L<N$;

applying an intermediate polyphase conversion to the plurality of sub-sets, thereby yielding a plurality of estimated intermediate-blocks of frequency coefficients;

wherein the intermediate polyphase conversion is based on an intermediate conversion matrix for mathematically transforming L short-blocks of M frequency coefficients to an accurate intermediate-block of L×M frequency coefficients; and wherein the intermediate polyphase conversion makes use of an approximation of the intermediate conversion matrix with a fraction of intermediate conversion matrix coefficients set to zero.

9. The method of claim 2, further comprising:

estimating a super long-block of frequency coefficients corresponding to a plurality of blocks of samples from a corresponding plurality of long-blocks of frequency coefficients; wherein the estimated super long-block of frequency coefficients has an increased frequency resolution compared to the plurality of long-blocks of frequency coefficients.

10. The method of claim 9, wherein the frequency dependent psychoacoustic processing is applied to the estimated super long-block of frequency coefficients.

11. The method of claim 2, wherein the frequency dependent psychoacoustic processing is applied to the estimated long-block of frequency coefficients.

12. The method of claim 1, wherein applying frequency dependent psychoacoustic processing comprises:

comparing a value derived from at least one frequency coefficient of the received block of frequency coefficients or from at least one frequency coefficient being determined on the basis of the received block of frequency coefficients to a frequency dependent energy threshold; and setting the frequency coefficient to zero if the frequency coefficient is below the energy threshold.

13. The method of claim 12, wherein the derived value corresponds to an average energy derived from a plurality of frequency coefficients for a corresponding plurality of frequencies.

14. The method of claim 1, wherein determining the chroma vector comprises:

classifying plural frequency coefficients of the received block of frequency coefficients or being determined on the basis of the received block of frequency coefficients to tone classes of the chroma vector; and determining cumulated energies for the tone classes of the chroma vector based on the classified frequency coefficients.

15. An audio encoder adapted to encode an audio signal, the audio encoder comprising:

a core encoder adapted to encode a downsampled component of the audio signal, wherein the core encoder is adapted to encode a block of samples of the downsampled component of the audio signal by transforming the block of samples of the downsampled component of the audio signal from the time domain into the frequency domain, thereby yielding a corresponding block of frequency coefficients in the frequency domain; and a processor adapted to determine a chroma vector of the block of samples of the downsampled component of the audio signal based on the block of frequency coefficients received from the core encoder, wherein the processor is further adapted to determine the chroma vector by applying frequency dependent psychoacoustic processing to the received block of frequency coefficients or to one or more frequency coefficients which are determined on the basis of the received block of frequency coefficients; wherein the chroma vector of the block of samples of the audio signal is indicative of melodic and/or harmonic content of the block of samples of the audio signal; wherein the melodic and/or harmonic content is to be stored on media or transferred via a network.

16. The encoder of claim 15, further comprising a spectral band replication encoder adapted to encode a corresponding high frequency component of the audio signal and also comprising a multiplexer adapted to generate an encoded bitstream from data provided by the core encoder and the spectral band replication encoder, wherein the multiplexer is adapted to add information derived from the chroma vector as metadata to the encoded bitstream.

17. An audio decoder adapted to decode an audio signal, the audio decoder being adapted to receive an encoded bitstream and adapted to extract a block of frequency coefficients from the encoded bitstream;

wherein the extracted block of frequency coefficients is associated with a corresponding block of samples of a downsampled component of the audio signal; and the audio decoder comprising:

a processor adapted to determine a chroma vector of the block of samples of the audio signal based on the extracted block of frequency coefficients, wherein the processor is further adapted to determine the chroma vector by applying frequency dependent psychoacoustic processing to the extracted block of frequency coefficients or to one or more frequency coefficients which are determined on the basis of the extracted block of frequency coefficients; wherein the processor is further adapted to determine melodic and/or harmonic content of the block of samples of the audio signal based on the chroma vector for the block of samples of the audio signal; wherein the melodic and/or harmonic content is to be stored on media or transferred via a network.

18. A non-transitory computer readable medium storing a software program adapted for execution on a processor and for performing the method steps of claim 1 when carried out on the processor.

19. A computer program product including a non-transitory computer readable medium comprising executable instructions for performing the method steps of claim 1 when executed on a computer.

* * * * *